US011834137B2

(12) United States Patent
Mast

(10) Patent No.: US 11,834,137 B2
(45) Date of Patent: Dec. 5, 2023

(54) FOLDING STOWABLE SEAT FOR A BOAT

(71) Applicant: HIGHWATER MARINE, LLC, Elkhart, IN (US)

(72) Inventor: Rod Mast, Warsaw, IN (US)

(73) Assignee: Highwater Marine, LLC, Elkhart, IN (US)

( * ) Notice: Subject to any disclaimer, the term of this patent is extended or adjusted under 35 U.S.C. 154(b) by 587 days.

(21) Appl. No.: 17/055,532

(22) PCT Filed: May 20, 2019

(86) PCT No.: PCT/US2019/033146

§ 371 (c)(1),
(2) Date: Nov. 13, 2020

(87) PCT Pub. No.: WO2019/222749

PCT Pub. Date: Nov. 21, 2019

(65) Prior Publication Data

US 2021/0214052 A1 Jul. 15, 2021

Related U.S. Application Data

(60) Provisional application No. 62/673,358, filed on May 18, 2018.

(51) Int. Cl.
*B63B 29/04* (2006.01)
*B63B 19/14* (2006.01)
(Continued)

(52) U.S. Cl.
CPC ..... *B63B 29/04* (2013.01); *B63B 19/14* (2013.01); *B63B 2029/043* (2013.01);
(Continued)

(58) Field of Classification Search
CPC .... B63B 19/14; B63B 29/04; B63B 2029/043
See application file for complete search history.

(56) References Cited

U.S. PATENT DOCUMENTS 2,502,061 A * 3/1950 Radford ..... B60N 2/305 296/156
3,202,453 A 8/1965 Richards
(Continued)

OTHER PUBLICATIONS

International Search Report and Written Opinion issued by the International Searching Authority, dated Jul. 22, 2019, for International Patent Application No. PCT/US2019/33146; 8 pages.

*Primary Examiner* — Andrew Polay
(74) *Attorney, Agent, or Firm* — Faegre Drinker Biddle & Reath LLP

(57) ABSTRACT

In one embodiment of the invention, a folding stowable seat for use on a boat is provided that includes a compartment in which the seat is stowed when not in use; a moveable lid attached with a hinged connection to the boat, the lid covering the compartment when the seat is stowed, and a top side of the lid configured for use as a step on the boat for use by boaters, and the lid is raisable about the hinged connection to an upright position to move the seat into a use position; a seat back; a seat bottom; and a movement assembly connecting the seat bottom to the compartment, the movement assembly facilitating movement of the seat bottom from a stowed position contained entirely within the compartment to a use position wherein the seat is at least partially outside of the compartment.

34 Claims, 23 Drawing Sheets

(51) Int. Cl.
*H01Q 1/38* (2006.01)
*H01Q 21/06* (2006.01)
*H01Q 21/24* (2006.01)

(52) U.S. Cl.
CPC ..... *H01Q 1/38* (2013.01); *H01Q 21/062* (2013.01); *H01Q 21/065* (2013.01); *H01Q 21/24* (2013.01)

(56) References Cited

U.S. PATENT DOCUMENTS

| | | | | |
|---|---|---|---|---|
| 4,637,081 | A | 1/1987 | Clark | |
| 6,283,059 | B1 | 9/2001 | Scully, Jr. | |
| 6,945,190 | B1 * | 9/2005 | Frandsen | B63B 29/04 114/364 |
| 8,375,880 | B1 | 2/2013 | St. Clair, Jr. | |
| 8,899,169 | B1 | 12/2014 | Jaziri | |
| 9,260,166 | B1 | 2/2016 | Fodor | |
| 2001/0002759 | A1 | 6/2001 | Nishide | |
| 2007/0035166 | A1 | 2/2007 | Summerford | |
| 2016/0214689 | A1 * | 7/2016 | Foss | B63B 29/04 |
| 2022/0348118 | A1 * | 11/2022 | Curts | B63B 29/06 |

* cited by examiner

FOLDING STOWABLE SEAT FOR A BOAT

CROSS-REFERENCE TO RELATED APPLICATIONS

The present application is a national stage entry of International (PCT) Patent Application Number PCT/US2019/33146, filed May 20, 2019, which in turn claims priority to U.S. Provisional Application Ser. No. 62/673,358, filed on May 18, 2018, the entire disclosures of which are hereby expressly incorporated herein by reference.

BACKGROUND

This disclosure relates to a folding stowable seat, and, in particular, to a folding stowable seat having a track system and hinged lid whereby the lid can serve as a stepping platform when the seat is in a stowed position.

Boating continues to rise in popularity, increasing the desire for versatile seating, lounging, and deck arrangements given the limited deck area available. For example, U.S. Pat. No. 5,799,605 to Huse, which is incorporated in its entirety herein by reference, discloses an extendable boat seat. The seat has a base unit with a storage area and slidable frame mounted to the base to slide outwardly therefrom. The extendable seat includes cushions, wherein in a retracted position, a first cushion is in the position of the seat and a second cushion forms the back of the seat. The second cushion includes a stepped region and a reduced cross-sectional area so that a portion of the cushion can be received in an interior storage area when the cushion is positioned as a seatback. When the seat is moved to an extended or lounge position, the first cushion moves forward to the foot area and the back cushion becomes the seat cushion.

U.S. Patent Application Publication No. 2010/0018451 to Sahr, which is incorporated in its entirety herein by reference, discloses a convertible seat and deck arrangement for a boat. The convertible seat elements can be pivoted upward to provide additional horizontal seating/lounging area. When the elements are in the horizontal position, foldable legs are placed generally perpendicular to the deck to support the horizontal elements. The elements can be pivoted to a vertical position located beneath the seat and the cushions located behind the leg area.

U.S. Pat. No. 4,926,783 to Lathers, which is incorporated in its entirety herein by reference, discloses a folding seat for use in a boat. The seat has a folded vertical position, an intermediate position, and an extended position including an extension cushion and leg support.

U.S. Pat. No. 5,329,871 to Gibbs, which is incorporated in its entirety herein by reference, discloses a swivel pedestal seat. The seat can remain in a normally upright position, but also to be pivoted into a lower center of gravity position adjacent the deck.

U.S. Pat. No. 5,913,571 to Dystra et a/, which is incorporated in its entirety herein by reference, discloses a marine seating apparatus having a one piece base to which a seat is affixed. The seat has a back portion divided into an upper and lower part by a living hinge and a bench portion. In one embodiment, a footrest portion is also included. The footrest and bench portions are integrally formed and are separated by another living hinge. In a standard position, the footrest is contained within the storage area of the seat, and the seat can be pivoted to unfold the footrest for use thereof.

U.S. Pat. No. 6,789,494 to Neese et a/, which is incorporated in its entirety herein by reference, discloses a fold out seat assembly attached to a support structure on a vertical mounting surface. The seat assembly has two sections including a back rest fixedly attached to the mounting surface above the seat assembly and a seat unit that is movable from a vertical stored position against the mounting surface to a horizontal seating position. Major portions of the seat unit are also detachable from the mounting surface when not needed.

U.S. Pat. No. 7,255,403 to Butler, which is incorporated in its entirety herein by reference, discloses a seat assembly for use in a watercraft. The seat assembly is designed to provide take-down seating and includes a first portion, a second portion, spaced from the first portion, and connector panels that are separable from and interconnect the first and second portions. A plurality of locking tabs extend from each of the connector panels for insertion into slots. A mounting bracket is attached to a base of each of the connector panels and perpendicularly extends the connector panels to mount the panels to the deck to thereby secure the first and second portions to the deck.

U.S. Pat. No. 7,367,616 to Summerford, which is incorporated in its entirety herein by reference, discloses a folding boat seat mountable to a vertical mounting surface such as the bulkhead of a boat. The system includes a seat, a pair of guide followers extending from opposite sides of the seat, a pair of guides mountable to the mounting surface and configured to receive the guide followers. A substantially U-shaped frame member having opposite ends is pivotally mounted adjacent the guide followers, and a pair of bias struts, each having a first end pivotally mounted adjacent one of the guides and a second end pivotally mounted to support the seat.

U.S. Pat. No. 8,028,641 to Sly, which is incorporated in its entirety herein by reference, discloses a convertible bench seat/platform for pontoon boats. The convertible bench seat is pivotally connected to the deck of a pontoon boat and is movable between an inboard position adjacent to the boat side rail for use as a bench seat and an outboard position for use as a platform for fishing, sitting, diving, and swimming.

U.S. Pat. No. 8,113,137 to Thompson, which is incorporated in its entirety herein by reference, discloses a folding seat with movable backrest. The movable seat and backrest are coupled by a pivoted link, allowing the seat to pivot from a raised stowed position to a lowered use position. A connecting link is coupled to one of the pivoted seat links, such that as the seat is lowered, the connecting link raises the backrest. When the seat is raised to a stowed position, the connecting link lowers the backrest to a lowered position. When mounted in a vessel, the backrest forms part of the bolster system when the seat is stowed.

SUMMARY

The subject disclosure discloses a foldable and stowable seat and a compartment for storing the seat in when not in use. A hinged lid is provided to cover the compartment and the lid can be used as a stepping platform when the seat is in the stowed position.

The disclosure, in one form thereof, provides a stowable seat for use on a boat, including: at least one wall defining a compartment; a moveable lid moveably connected to the boat and moveable relative to the wall, the moveable lid moveable through a lid range of motion between: a step position covering the compartment and presenting a stepping surface to support a user walking atop the moveable lid over an area of the boat; and a seat back position allowing access to the compartment; and a seat bottom moveably secured relative to the wall and moveable through a seat bottom range of motion between: a stowed position within the compartment and covered by the moveable lid in the step position of the moveable lid; and a use position with the seat bottom extending from the compartment for use as a seat over the area of the boat, the moveable lid maintaining the seat position to allow the seat bottom to be positioned in the use position, in the seat position the moveable lid oriented to provide back support to a user seated on the seat bottom.

In alternative configurations, the stowable seat may further comprise a seat back. In further alternative configurations, the seat back may comprise: a seat back face of the moveable lid opposite the stepping surface; or be pivotally connected to the seat bottom and pivotable into a use position atop the moveable lid in the seat back position of the moveable lid.

In alternative embodiments thereof, the stepping surface of the moveable lid may comprise a non-slip surface.

In alternative embodiments thereof, the stowable seat may comprise a magnetic retainer positioned to selectively magnetically retain the moveable lid in the seat back position.

In certain embodiments of the present disclosure, the at least one wall defining the compartment comprises a pair of sidewalls, a front wall, and a back wall. Certain alternative embodiments of the present disclosure may feature slot in the pair of sidewalls, with the stowable seat further comprising a slide attached to the seat bottom. In alternative forms thereof, the slots in each of the sidewalls has a substantially j-shaped configuration, and each of two opposing ends of the slide are located in and configured to be moveable within one of the slots through the seat bottom range of motion. In certain embodiments of the disclosure, the ends of the slide are located in a lower end of the j-shaped configuration slots when the seat bottom is in a stowed position and the ends of the slide are each located in a niche at an end of an arch of each of the j-shaped configuration slots when the seat bottom is in the use position.

In alternative configurations of the present disclosure, the seat bottom is supported on a ledge when the seat bottom is in the use position.

In further alternative configuration so the present disclosure, the moveable lid comprises a seat back, the seat back positioned in the compartment when the moveable lid is positioned for use as a step.

Certain embodiments of the present disclosure feature a stowable seat in combination with a boat. In further alternative embodiments, the boat may feature a front facing stowable seat and a rear facing stowable seat.

In one embodiment of the disclosure, a stowable seat is provided that includes a compartment; a seat back; a seat bottom; a movement assembly connecting the seat bottom to the compartment, the movement assembly facilitating movement of the seat bottom from a stowed position contained entirely within the compartment to a use position wherein the seat bottom is at least partially outside of the compartment; and a moveable lid attached with a hinged connection to the boat, the lid covering the compartment when the seat bottom is stowed, and a top side of the lid is configured for use as a step, and the lid is raisable about the hinged connection to an upright position to allow the seat bottom to be moved into a use position.

In certain embodiments of the stowable seat, the at least one wall defining a compartment comprises a pair of sidewalls, and the movement assembly includes a slot in each of the sidewalls defining the compartment, and a slide may be attached to the seat bottom. In certain embodiments, the slot in each of the sidewalls has a substantially j-shaped configuration, and each of the two opposing ends of the slide may be located in and configured to be moveable within one of the slots. The j-shaped configuration slots may be, in certain embodiments, inverted in the sidewalls of the compartment. In alternative embodiments, the inverted j-shaped configuration slots are angled forward.

In one aspect of the disclosure, the ends of the slide may be located in a lower end of the j-shaped configuration slots when the seat bottom is in a stowed position. In another aspect of the disclosure, the ends of the slide may each be located in a niche at an end of an arch of each of the j-shaped configuration slots when the seat bottom is in the use position.

In certain embodiments, the seat back maintains a substantially vertical orientation in the compartment when the seat is in the stowed position. In certain embodiments of the disclosure, the seat bottom also maintains a substantially vertical orientation in the compartment when the seat bottom is in the stowed position. The stowable seat may, in certain embodiments, include a pivoting connection connecting the seat bottom and the seat back. The stowable seat, in certain embodiments, includes a cavity beneath the lid when the lid is in a raised upright position, and a retainer is connected to the seat bottom, the retainer received in the cavity when the seat bottom is in the use position. In embodiments employing the retainer, the retainer may abut a bottom wall of the compartment when the seat is in the stowed position. In certain embodiments, the seat bottom is supported opposite the retainer on a ledge when the seat bottom is in the use position.

In alternative embodiments of the disclosure, the seat back maintains a substantially horizontal orientation when the seat bottom is in the stowed position. The seat back is, in certain embodiments, attached to the lid, the seat back positioned in the compartment when the moveable lid is positioned for use as a step. The stowable seat further includes, in certain embodiments, a support attached to the seat bottom, and the support abuts a bottom wall of the compartment when the seat bottom is in the stowed position. The stowable seat includes, in certain embodiments, at least one retainer that abuts a front ledge of the compartment when the seat bottom is in a use position to prevent the seat bottom from moving from the use position when a boater is sitting thereon.

The stowable seat, in alternative embodiments thereof, further includes a strap attached to the seat back. The strap of alternative embodiments is positioned to allow a boater to raise the seat bottom from the stowed position to the use position while grasping the strap.

Certain embodiments of the present disclosure feature a stowable seat in combination with a boat. In further alternative embodiments, the boat may feature a front facing stowable seat and a rear facing stowable seat.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

DETAILED DESCRIPTION OF EMBODIMENTS OF THE DISCLOSURE

Figure 1:
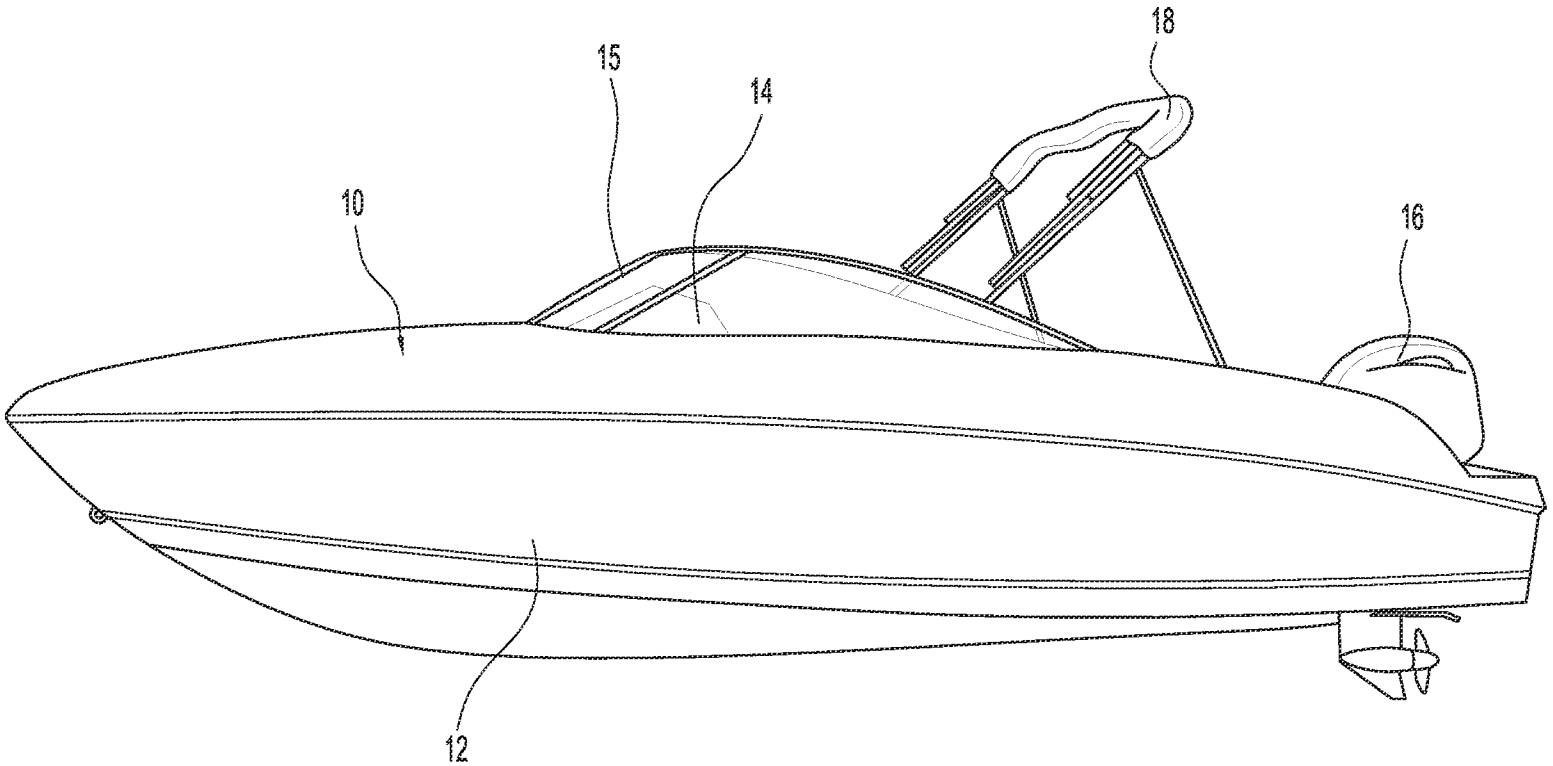
FIG. 1 is a perspective view of a boat including folding stowable seats in accordance with embodiments of the subject disclosure.

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Now referring to FIG. 1, a boat is shown, generally indicated as 10. Boat 10, as depicted, is a variety commonly referred to as a sport boat and is well known; however, it should be appreciated that the present invention may be utilized on other types of boats and is not restricted for use on a sport boat. In the embodiment shown, sport boat 10 includes a hull 12, a cockpit 14, a windshield 15 around the cockpit, an outboard engine 16 and a foldable canopy 18.

Figure 2:
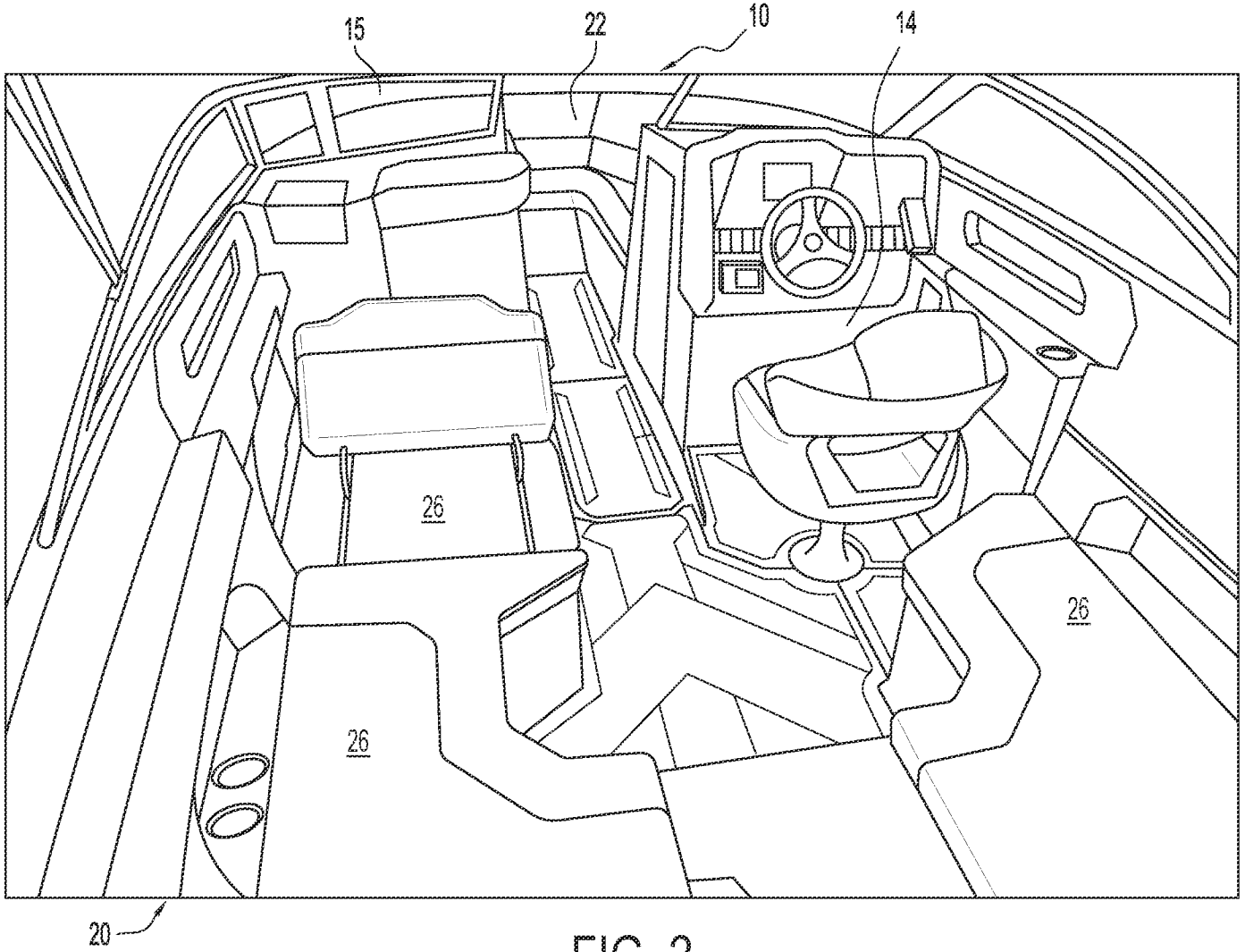
FIG. 2 is a rear perspective view of the boat of FIG. 1 showing an interior view thereof.

Now referring to FIG. 2, boat 10 includes an interior seating arrangement, generally indicated as 20. As is clearly shown in FIG. 2, interior seating arrangement 20 of boat 10 includes a plurality of seats including seats 22 in the bow of boat 10, a captain's chair 24, and a plurality of side seats 26.

Figure 3:
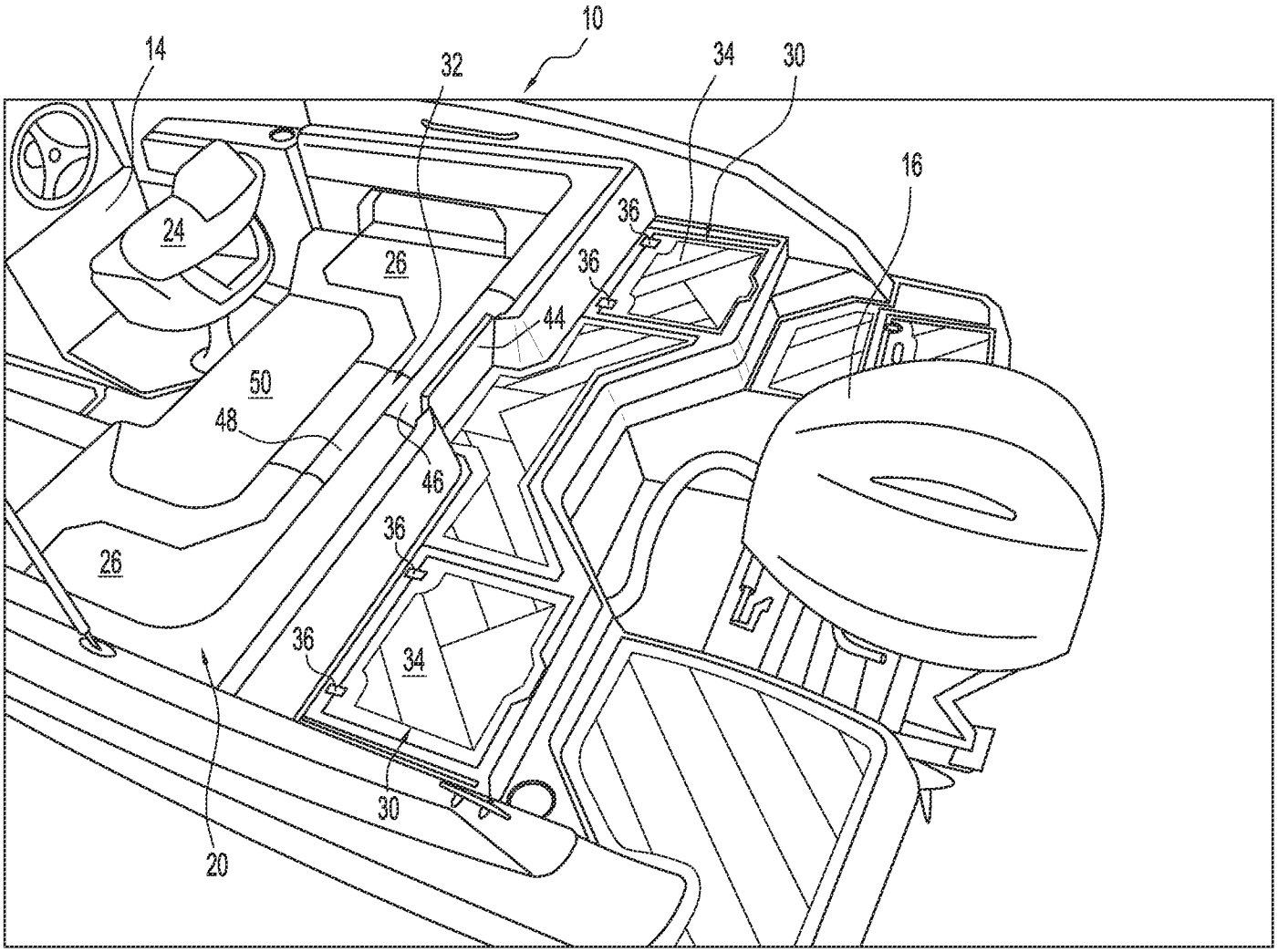
FIG. 3 is a perspective view of a stern portion of the boat of FIG. 1 showing two stowable and foldable seats in accordance with embodiments of the subject disclosure with a rear facing seat being in a stowed position for use as a step and a front facing seat in an unfolded use position for use as a seat.
Figure 4:
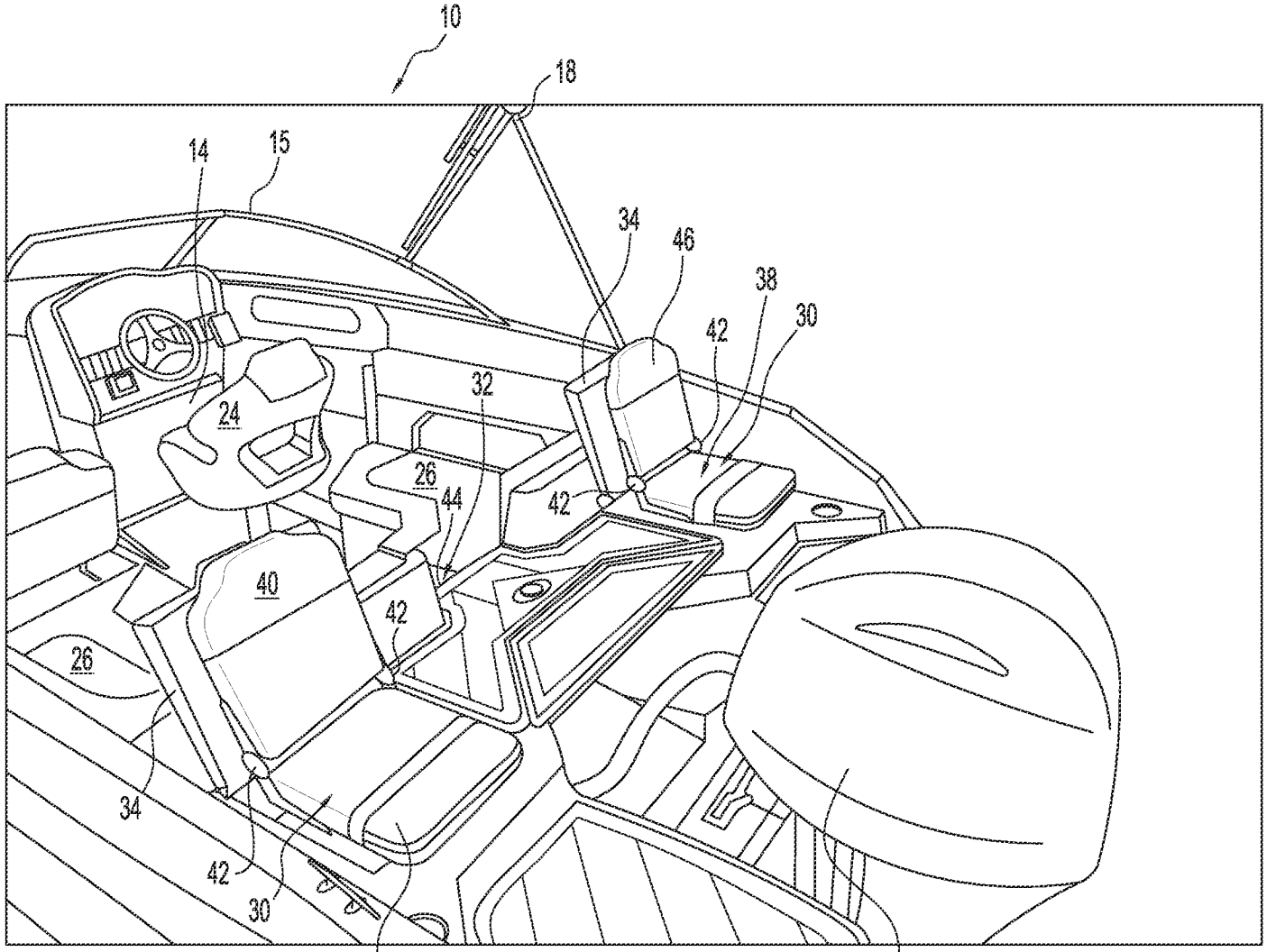
FIG. 4 is another perspective view of a stern portion of the boat of FIG. 1 with the rear facing folding stowable seat in an open use position as a seat and the front facing seat in a stowed position.

Now referring to FIGS. 3 and 4, boat 10 also includes a pair of rear facing folding and stowable seats, generally indicated as 30, and a front facing folding and stowable seat, generally indicated as 32. All of the folding stowable seats move between a folded and stowed position wherein the seats are contained in a compartment and a lid over top of the compartment serves as a step on boat 10 and an unfolded use position for use as a seat. In FIG. 3, the rear facing folding and stowable seats 30 are shown in the stowed position and front facing stowable seat 32 is in an upright use position. In FIG. 4, rear facing folding and stowable seats 30 have been moved to the upright use position for use as a seat, whereas, front facing folding and stowable seat 32 has been folded to the stowed position. Rear facing seats 30 include lids 34 which the backside thereof serve as a step on boat 10 for boaters thereon when the seat 30 is in the folded position (see FIG. 3). Lids 34 are connected to boat 10 with a pair of hinges 36. Rear facing seats 30 also each include a seat bottom 38 with a seat bottom cushion as dearly shown in, e.g., FIGS. 4 and 6-9, and a pivoting seat back or backrest 40. Seat backs 40 are connected to seat bottoms 38 with a pivoting connector 42.

Front facing seat 32 also includes a lid 44, which can be used as a stepping surface when the seat is in a folded and stowed position. A back cushion 46 is attached beneath lid 44 so that when front facing seat 32 is in an upright use position, lid 44 services as a seat back. Front facing seat 32 also includes a seat bottom 48 with a seat bottom cushion as clearly shown in, e.g., FIGS. 19, 21, 23 and 24. In an embodiment shown, boat 10 also includes a removable sun pad 50 that can be placed in front of front facing seat 32 and between side seats 26.

Figure 5:
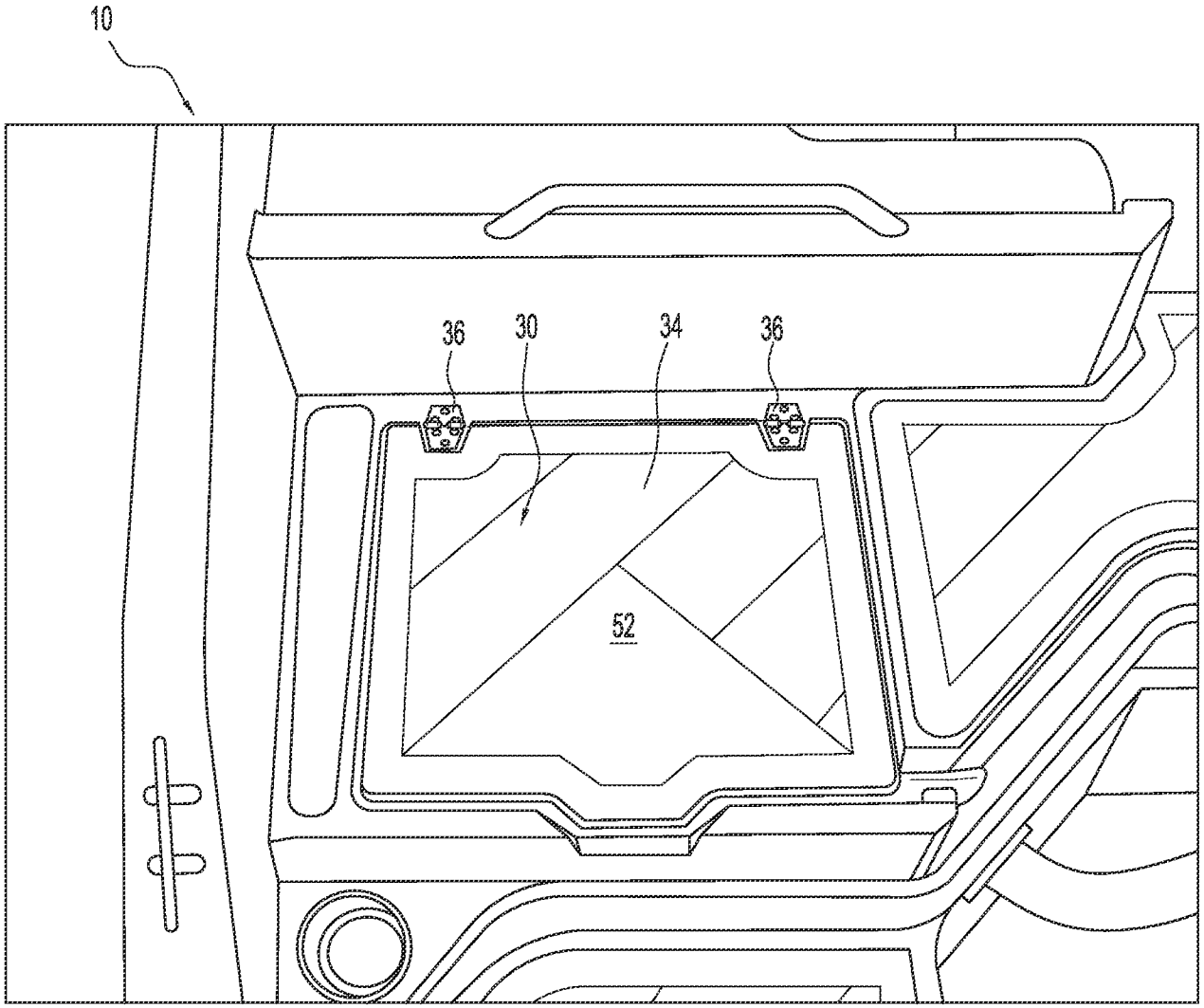
FIG. 5 is a plan view of the rear facing folding stowable seat in a stowed position for use as a step.

Now referring to FIGS. 5-17, details of rear facing folding and stowable seat 30 are provided. As shown in FIG. 5, lid 34 can include a non-slip surface 52 on the top thereof to prevent boaters from slipping thereon, which may be a concern, especially if wet.

Figure 6:
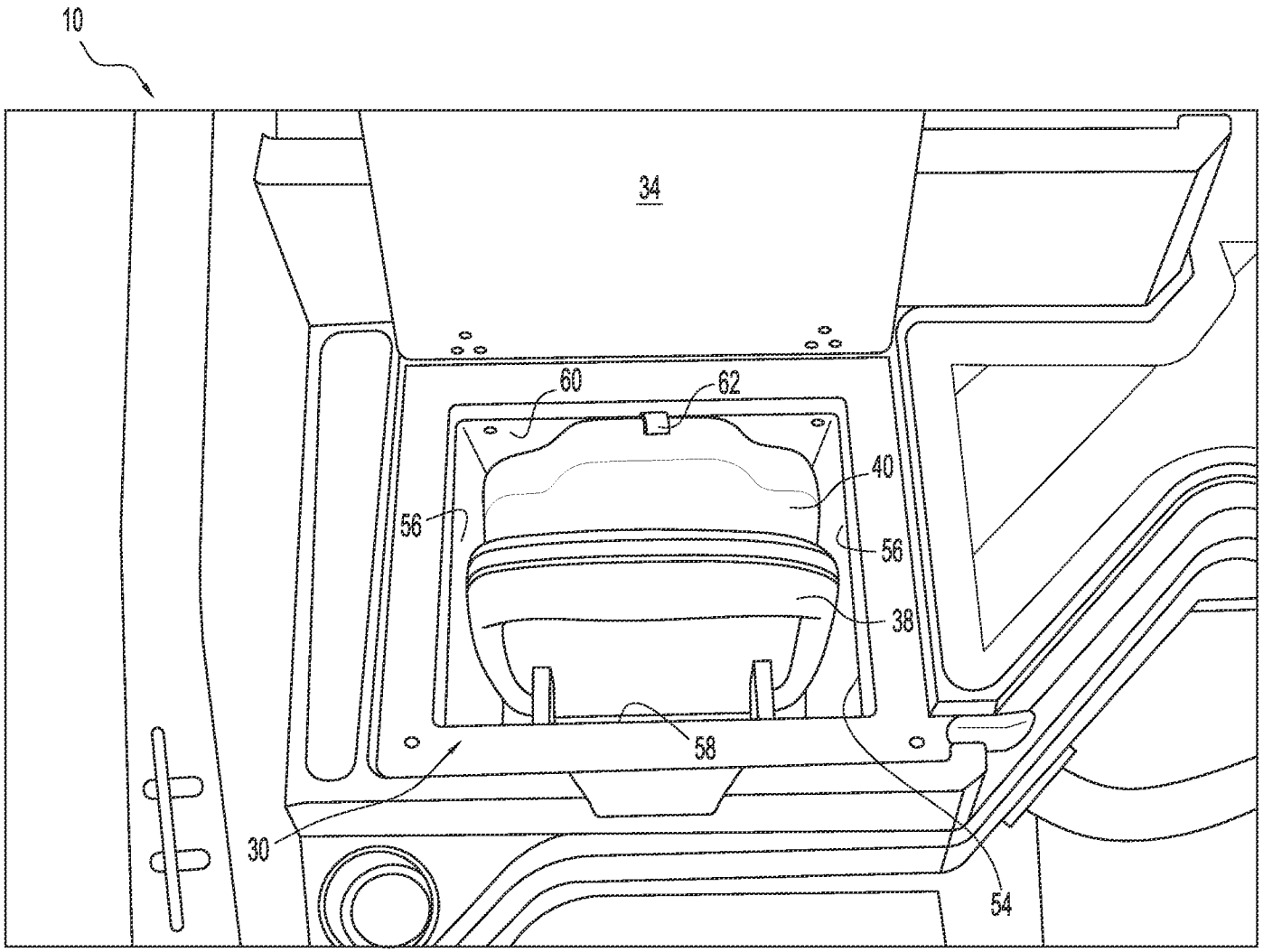
FIG. 6 is a plan view of the rear facing folding stowable seat of FIG. 5 with the step lid opened, but the seat still being folded and stowed.
Figure 7:
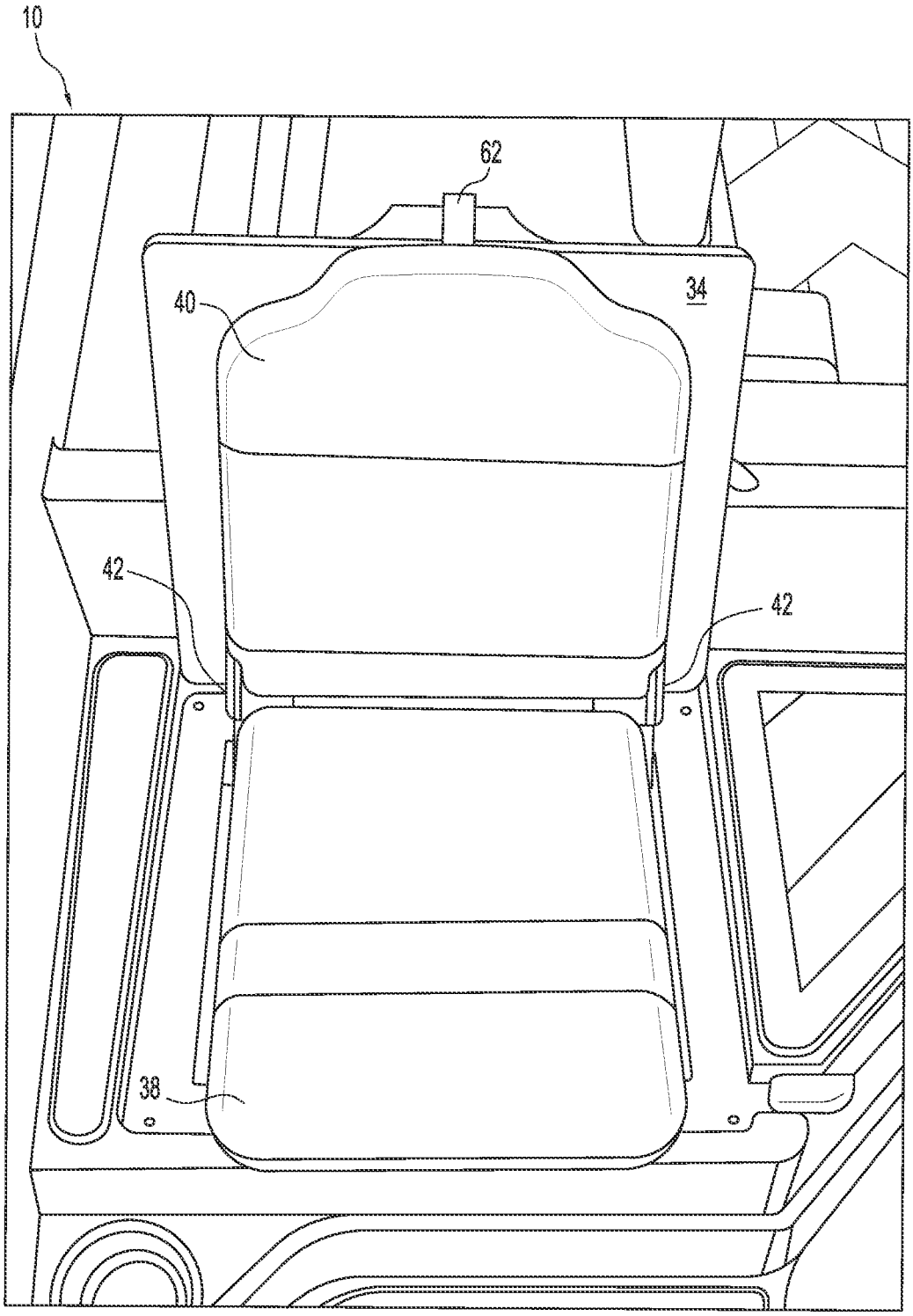
FIG. 7 is a front view of the rear facing folding stowable seat in an unfolded use position as a seat.

As shown in FIG. 6, rear facing folding stowable seat 30 is stored in a compartment, generally indicated as 54, when not in use. Compartment 54 includes a pair of sidewalls 56, a front wall 58, a back wall 60, and a bottom wall 61 (see FIGS. 11-15). A ledge 55 (FIG. 14) is located in front of compartment 54. As should be appreciated, lid 34 can swing about hinges 36 to cover rear facing folding and stowable seat 30 when not in use or opened, as shown in FIG. 6, in order to move rear facing seat 32 to an upright use position. A strap 62 is attached to seat back 40 to enable a boater to easily pull rear facing seat 30 up and out of compartment 54 to an upright use position. With the mechanism of the subject disclosure, the pulling the rear facing seat out of compartment 54 an into the use position can be accomplished using a single finger.

Figure 8:
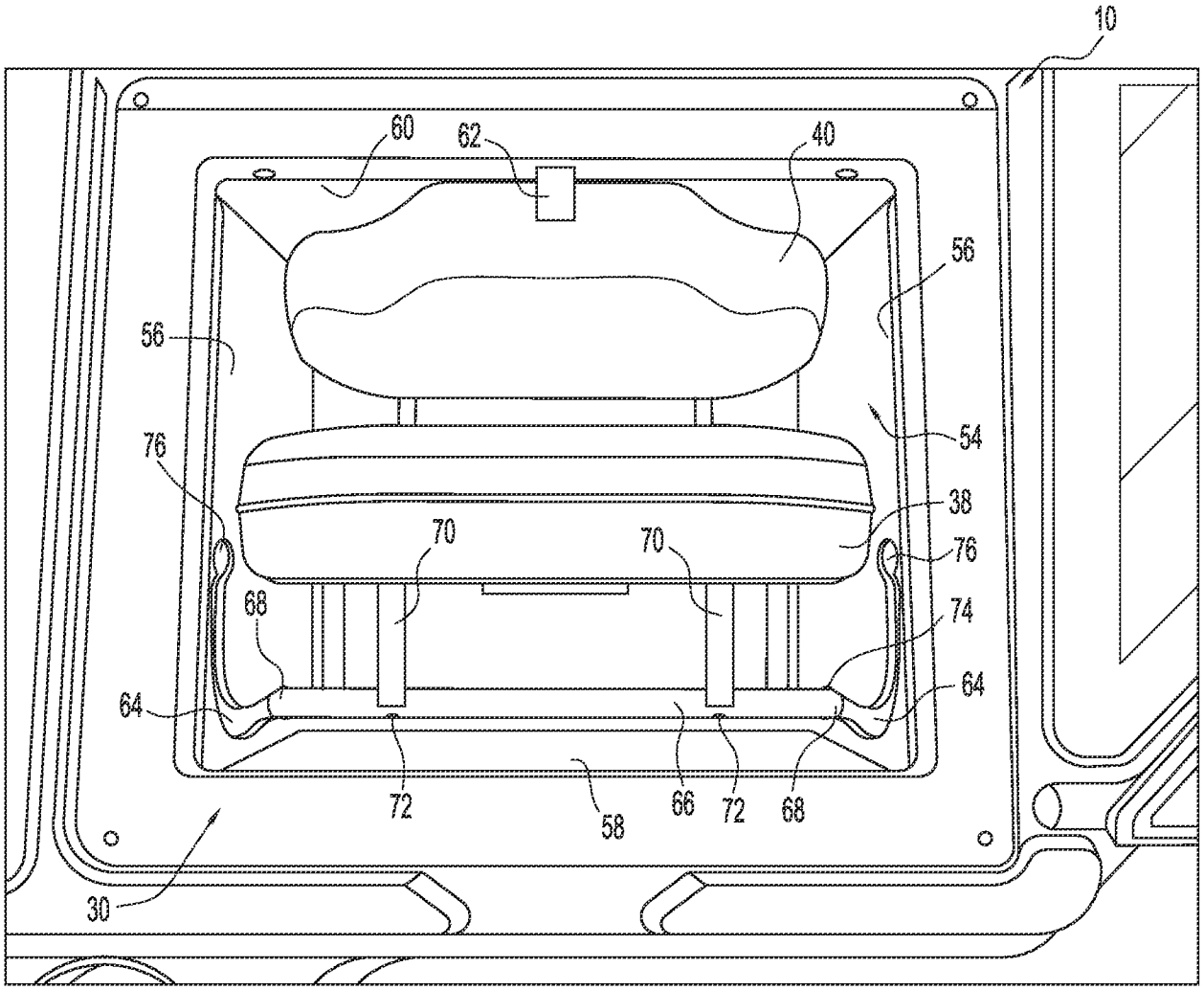
FIG. 8 is an enlarged plan view of the folding rear facing folding stowable seat of FIG. 6 showing details of the components on which the seat moves.
Figure 9:
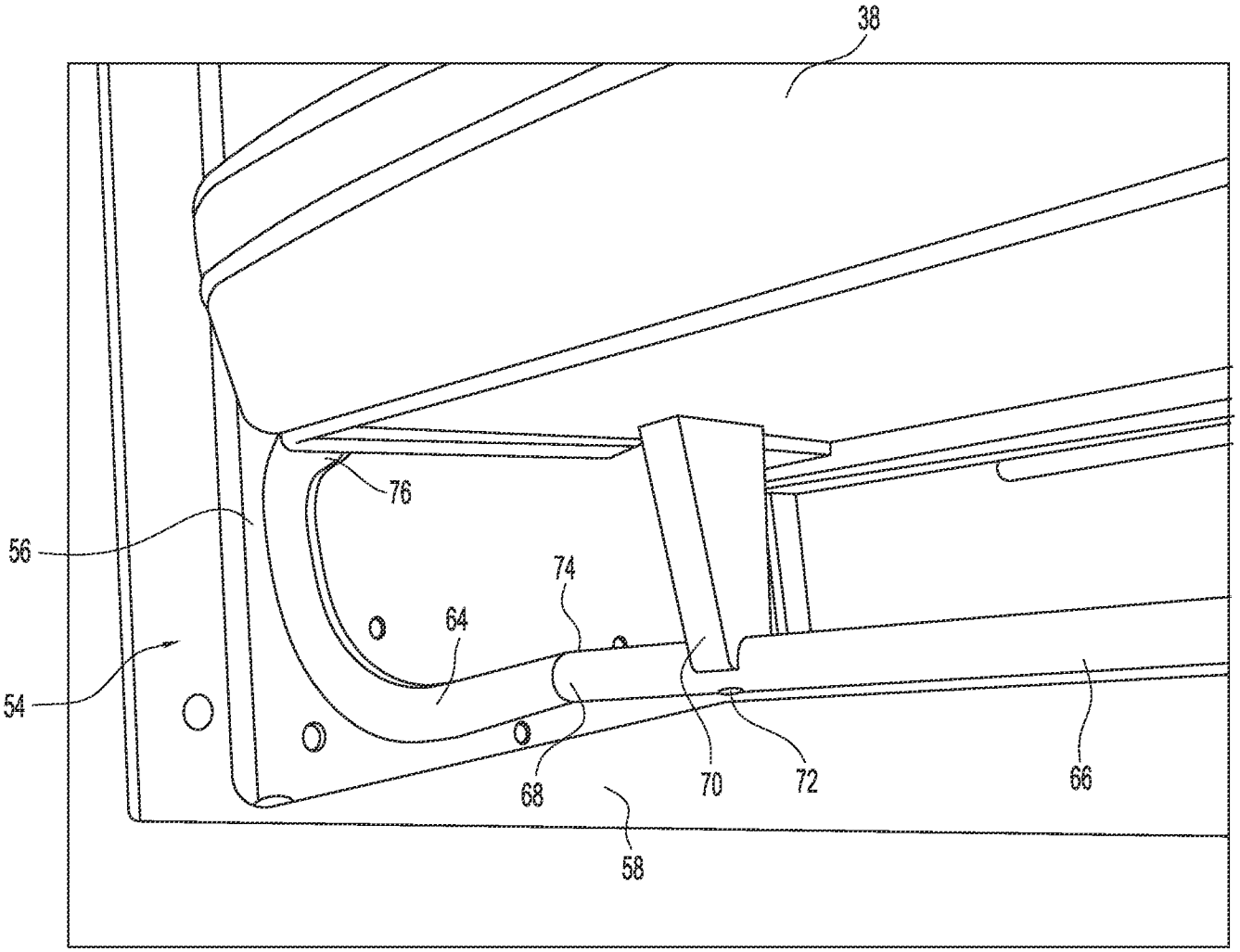
FIG. 9 is an enlarged perspective view of the folding stowable rear facing folding stowable seat of FIG. 5 showing further details of the components for moving the seat.
Figure 10:
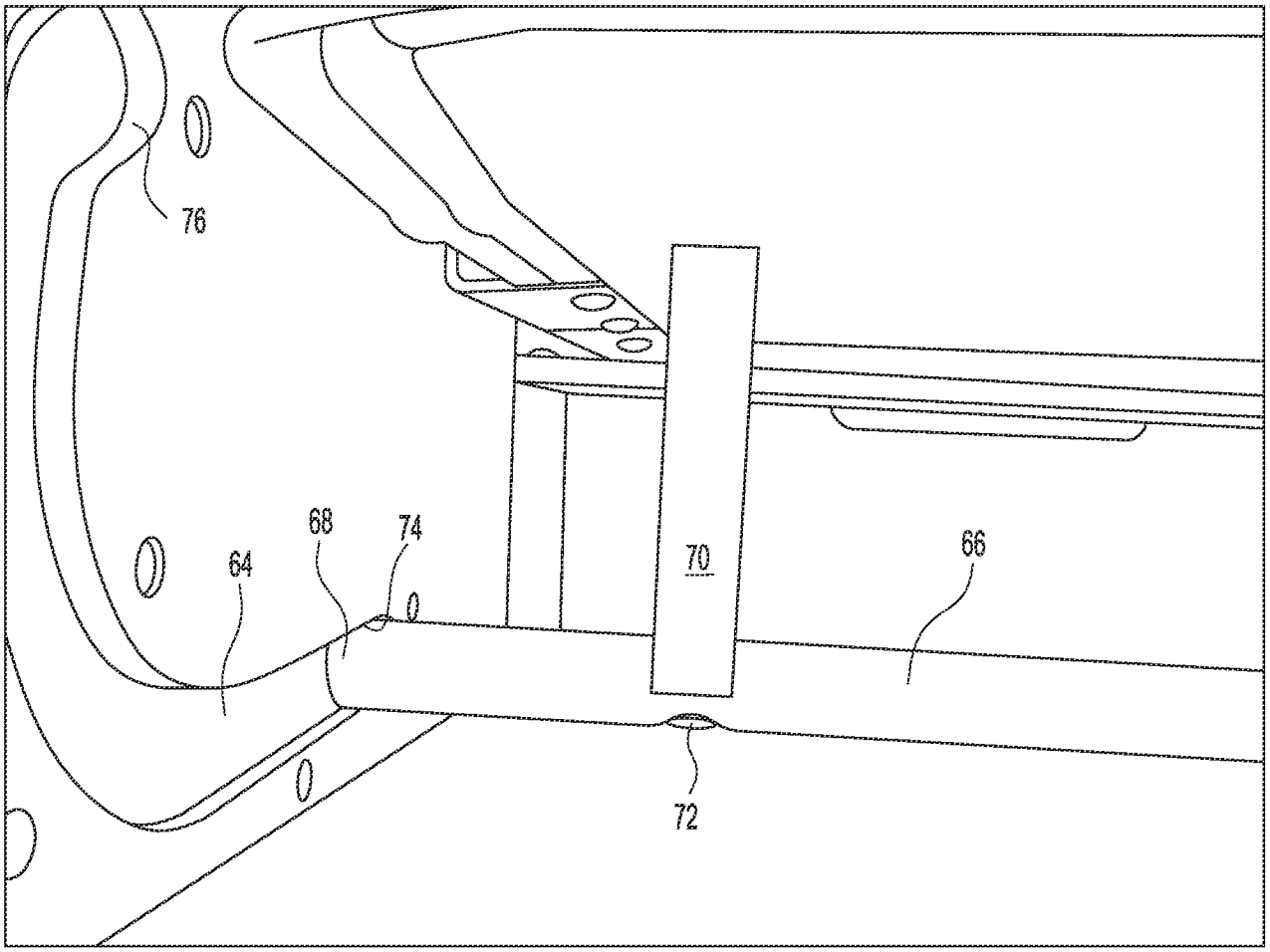
FIG. 10 is another enlarged perspective view of the components for moving the rear facing foldable stowable seat of FIG. 5.

Now referring to FIG. 8, details of the components of rear facing seat 30 that allow it to be readily moved between the stowed position and upright use position are shown. In particular, sidewalls 56 each contain slots 64, which have a substantially inverted j-shaped configuration. The movement components also include a slide 66 of which ends 68 thereof are received in slots 64. Slide 66 is mounted to seat bottoms 38 using brackets 70 and fasteners 72. When seat 30 maintains stowed position, ends 68 of slide 66 are located at the end 74 of the straight section of j-shaped slot 64. At the other end of slot 64, wherein the arch of the j-shape terminates, a niche 76 is located wherein ends 68 of slide 66 reside when seat 30 is in the upright use position. The arch and niche help retain slide 66 in the upright use position to prevent the seat from folding unintentionally.

Figure 11:
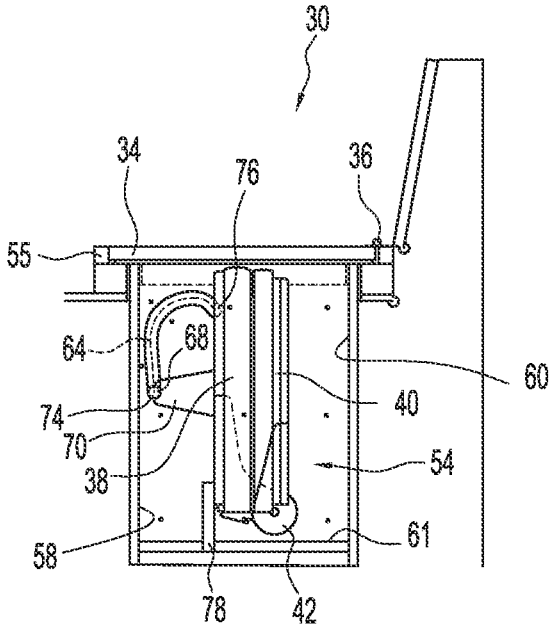
FIG. 11 is a side view of the rear facing folding stowable seat of FIG. 5 shown in the stowed position for use as a step.

Now referring to FIG. 11-15, figures depicting the placement and movement from a stowed position to an upright use position as a seat are depicted. In FIG. 11, the seat is shown in the stowed position where it is completely contained within compartment 54. As noted above, ends 68 of slide 66 are located at the bottom ends 74 of slots 64. The seat is in a folded position with the seat bottom 38 parallel and adjacent to seat back 40.

Figure 12:
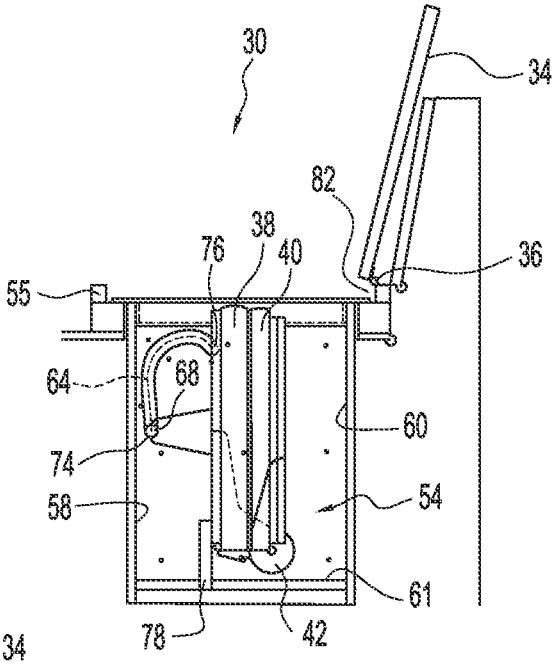
FIG. 12 is a side view of the folding stowable seat of FIG. 5 with the step lid raised but the seat still in the folded stowed position.
Figure 13:
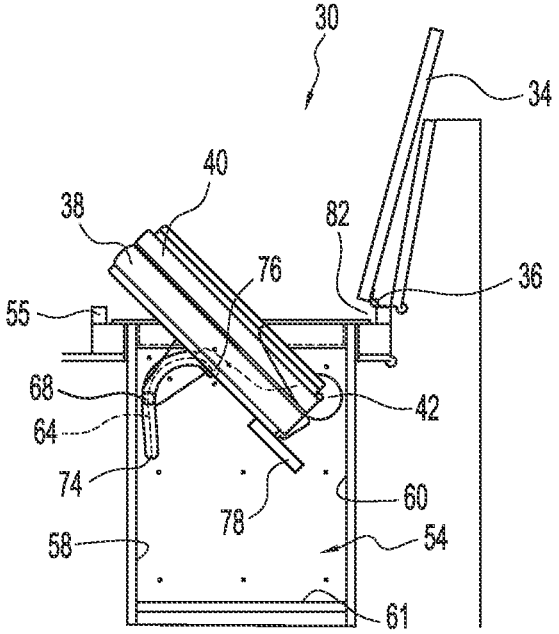
FIG. 13 is a side view of the rear facing folding stowable seat of FIG. 5 with the seat partially moved between the stowed position and a use position as a seat.

Referring now to FIG. 12, rear facing seat 30 is still folded and contained in compartment 54; however, stepping lid 34 has been raised about hinges 36 to open the top of compartment 54 so that seat 30 may be pulled therefrom. FIG. 13 depicts rear facing seat 30 in a partially moved position wherein ends 68 of slide 66 have been moved up slot 64 to an approximately central portion thereof. In this position, seat bottom 38 and seat back 40 are still adjacent to and parallel to one another in a folded position, but they are now extending at an approximately 45 degree angle as opposed to being in a vertical orientation as shown in FIGS. 11 and 12.

Figure 14:
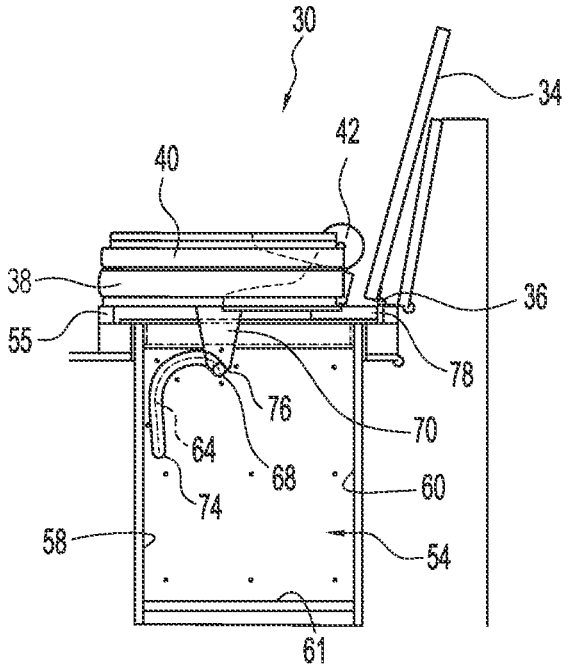
FIG. 14 is a side view of the rear facing folding stowable seat of FIG. 5 with the seat in a raised position, but with the seat back still down.

In FIG. 14, seat bottom 38 has been moved to the use position wherein end 68 of slide 66 is positioned in niche 76 of slot 64. Seat bottom 38 is in a generally horizontal position with a front of the seat bottom supported by ledge 55; however, seat back 40 is still in a folded position adjacent to and parallel to seat bottom 38.

Figure 15:
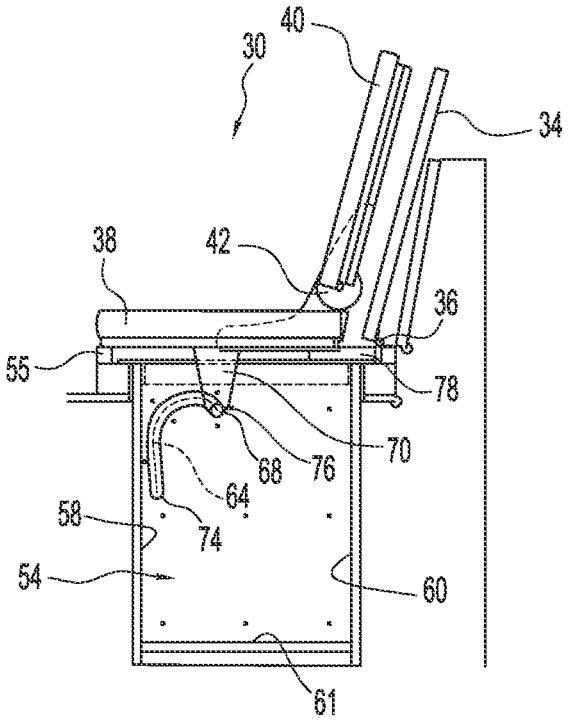
FIG. 15 is a side view of the rear facing folding stowable seat of FIG. 5 with the seat back raised in the seat in the use position.
Figure 16:
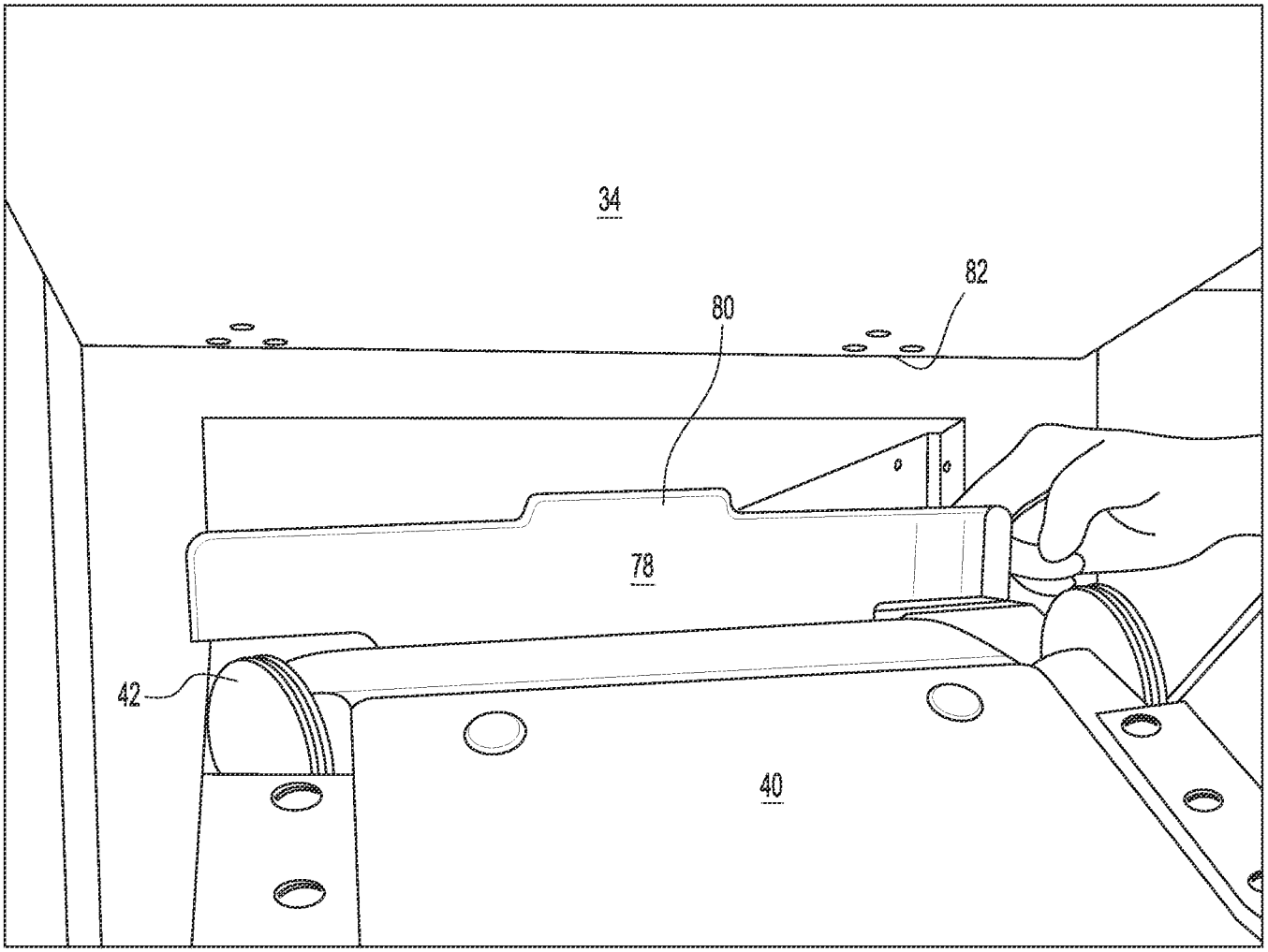
FIG. 16 is a plan view of a securing bar for the rear facing foldable stowable seat to prevent the seat from moving or folding while being occupied.
Figure 17:
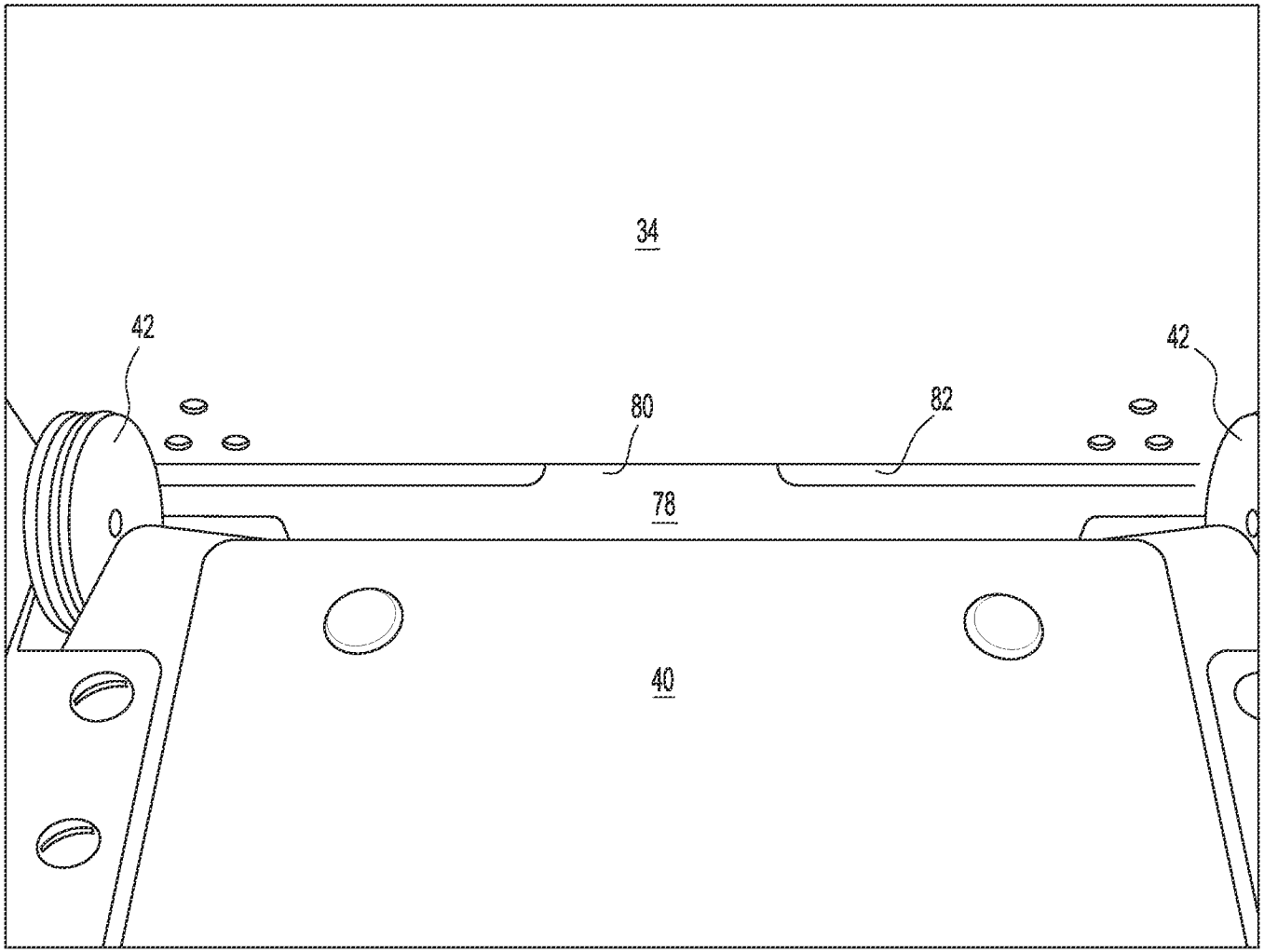
FIG. 17 is an enlarged view of the securing bar of the rear facing foldable stowable seat of FIG. 5 securing the seat.
Figure 18:
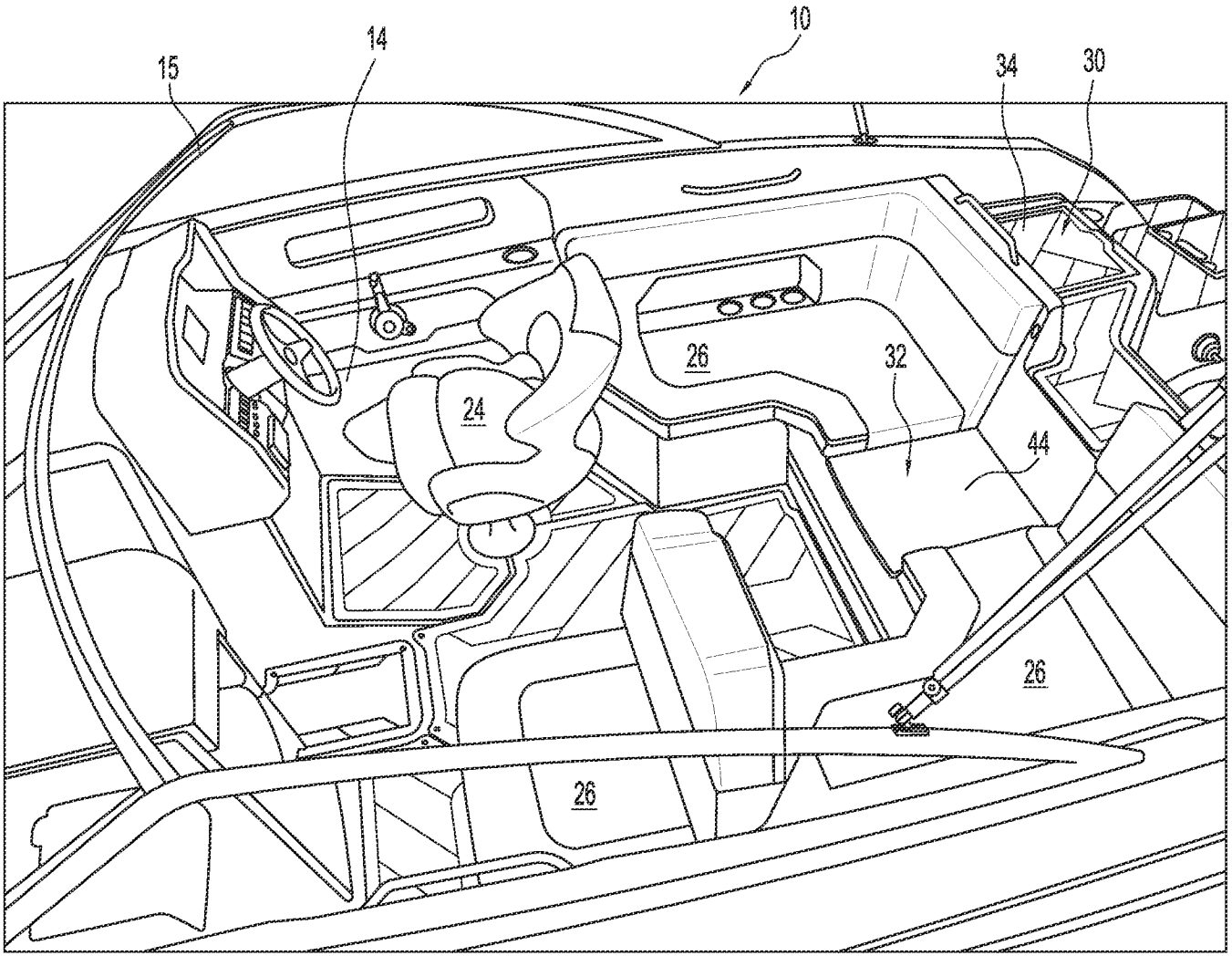
FIG. 18 is a side perspective view of the interior of the boat of FIG. 1 showing the front facing folding stowable seat in a folded and stowed position for use as a step.

In FIG. 15, seat back 40 has been raised or pivoted about pivoting connection 42 to the final in use position. In addition to niche 76 retaining slide 66 in position, a securing bar is also provided that prevents rear facing seat 30 from folding up while a boater is sitting thereon.

Referring to FIGS. 11-17, a retainer bar 78 is attached to seat bottom 38 and in one embodiment, retainer bar 78 includes an extension 80 (FIG. 16) extending from a middle portion thereof. When seat bottom 38 moves into the horizontal position shown in FIG. 14, the retainer bar 78 moves to a horizontal position extending into a cavity 82 that is beneath the bottom edge of lid 34 (see FIGS. 12 and 13). Accordingly, extension 80 of retainer bar 78 is received in cavity 82 to prevent seat bottom 38 from being lifted while a boater is sitting thereon. Additionally, as should appreciated from FIGS. 14 and 15, retainer bar 78 rests on a ledge beneath cavity 82 to support the back of rear facing seat 30. When the seat is in a stowed position, the retainer bar can be abutting bottom wall 61 of compartment 54.

Figure 19:
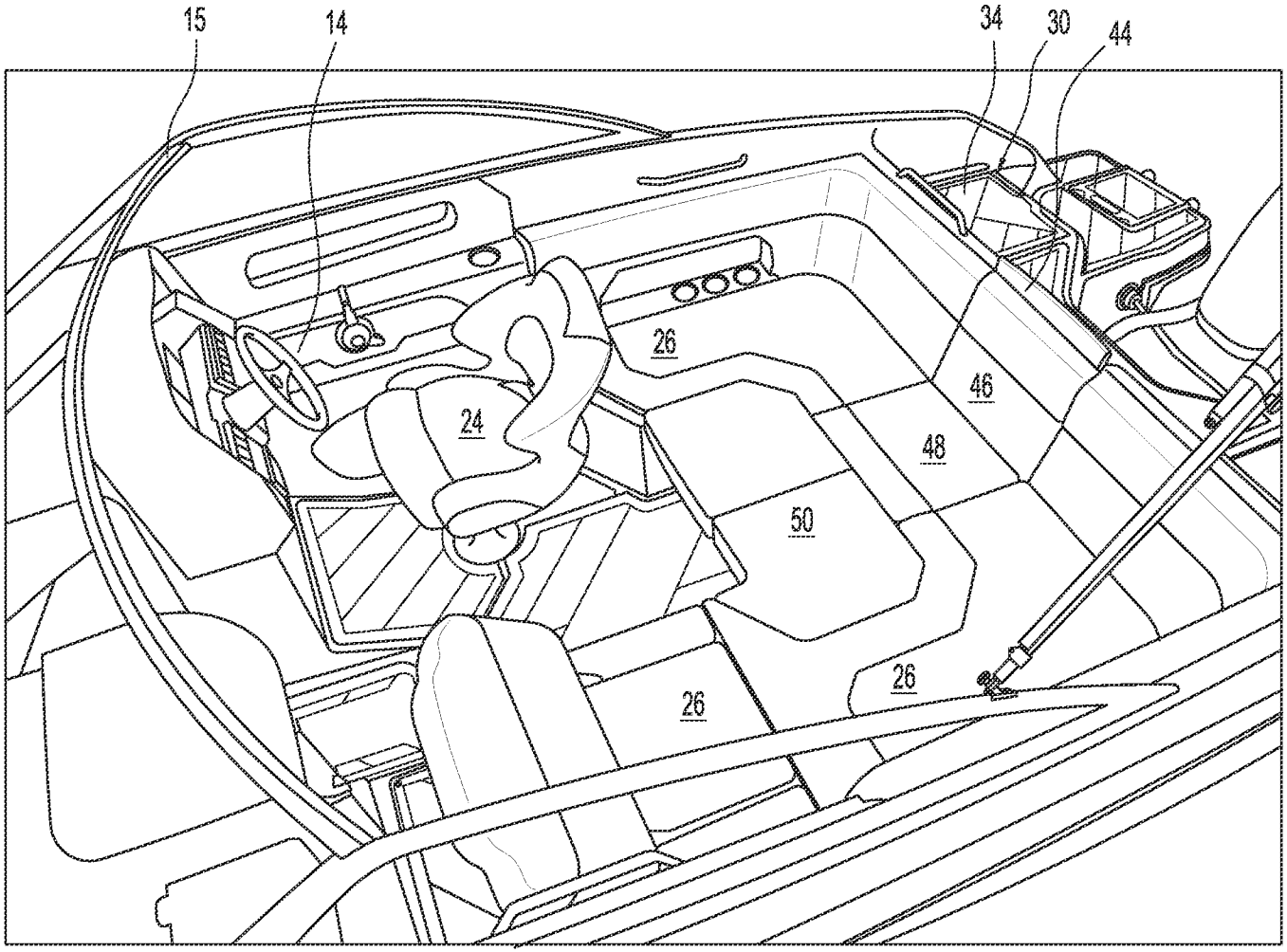
FIG. 19 is a side perspective view of the interior of the boat of FIG. 1 showing the front facing folding stowable seat in an upright unfolded position for use as a seat.
Figure 20:
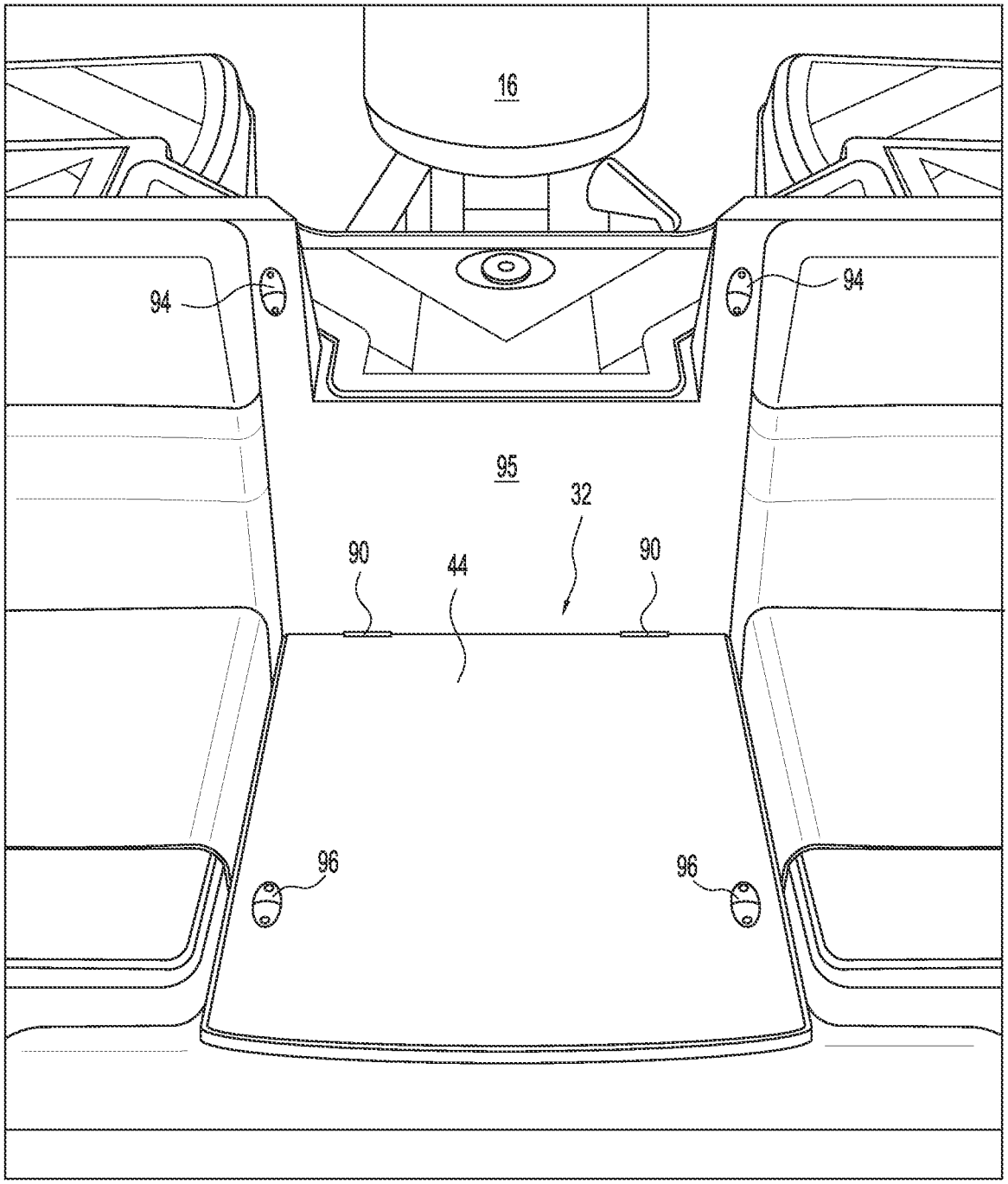
FIG. 20 is a front view of the front facing folding stowable seat in folded position for use as a step.
Figure 21:
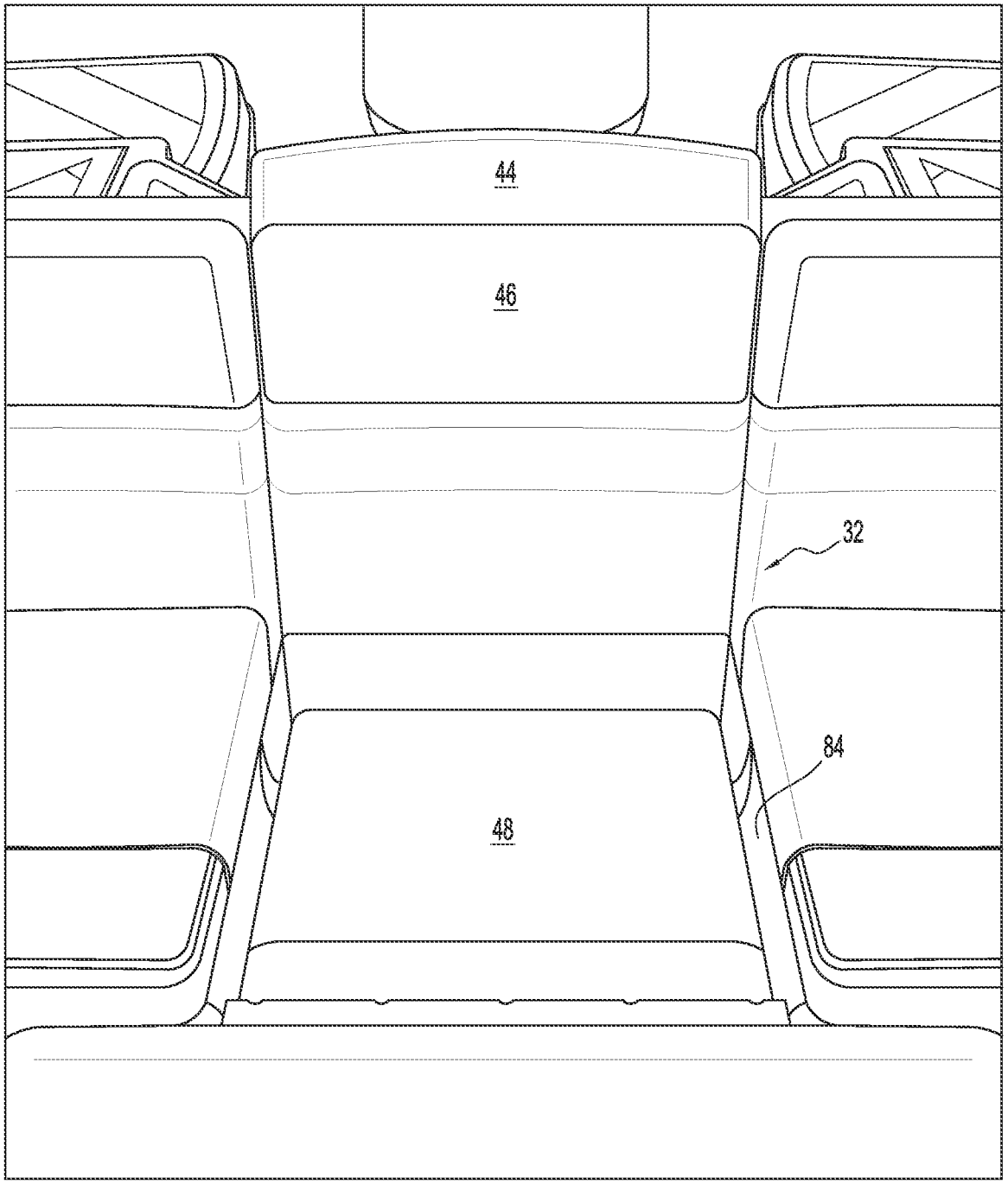
FIG. 21 is a front view of the front facing folding stowable seat in the upright unfolded position for use as a seat.
Figure 22:
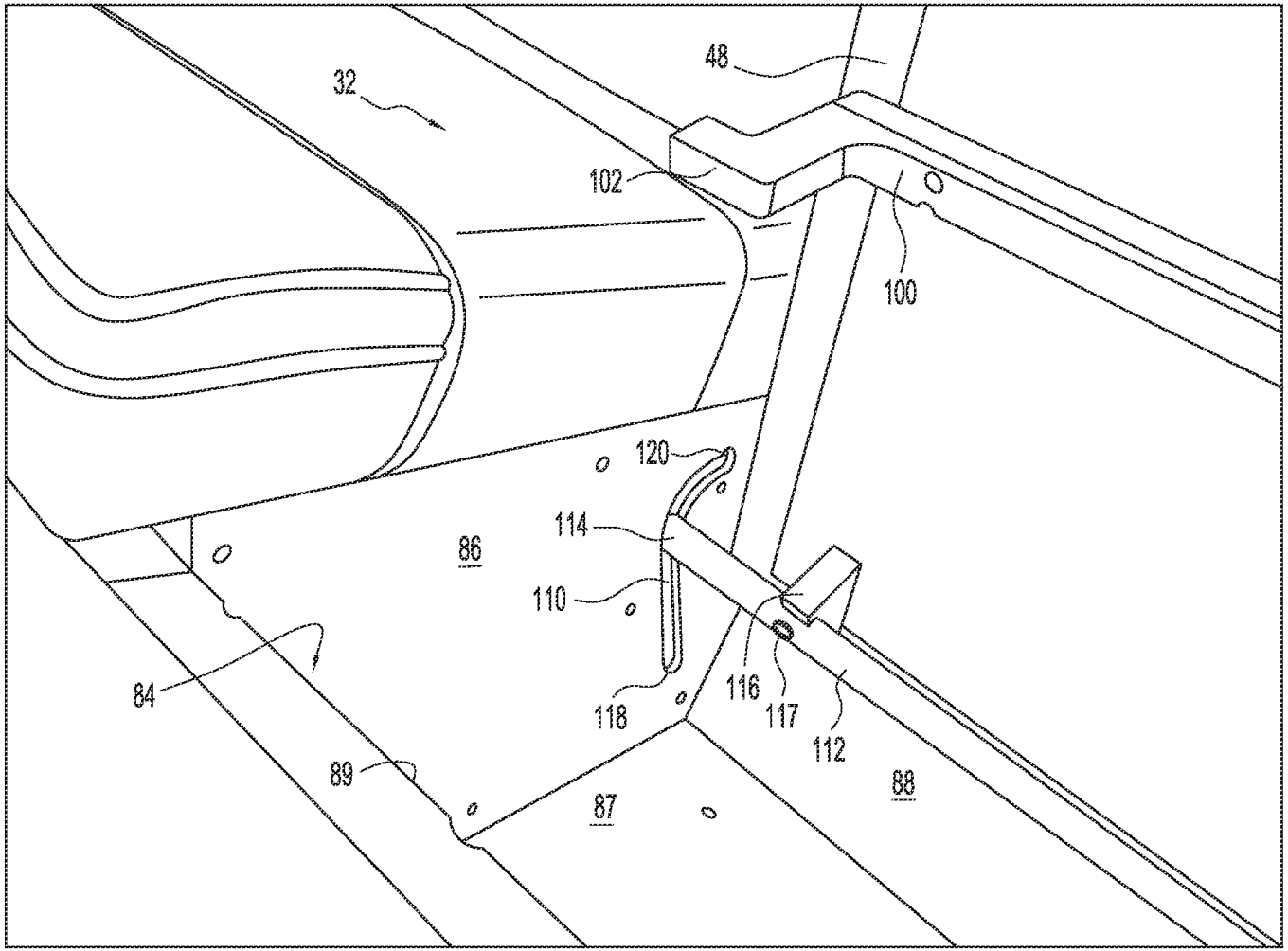
FIG. 22 is a perspective view showing the components that move and retain the front facing foldable stowable seat in the desired position.
Figure 23:
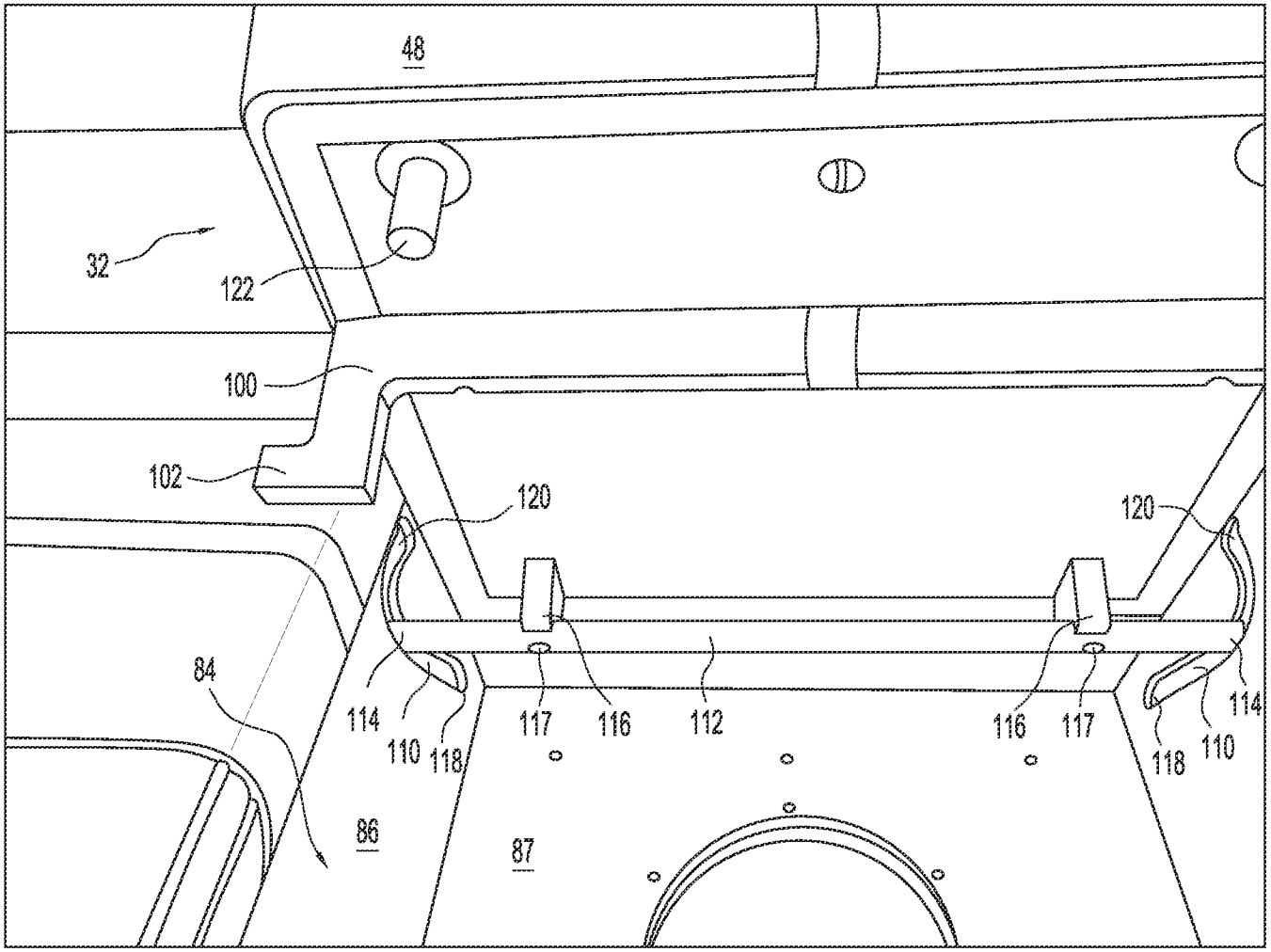
FIG. 23 is another perspective view showing the front facing folding stowable seat in a partially unfolded position and the components for moving the seat.
Figure 24:
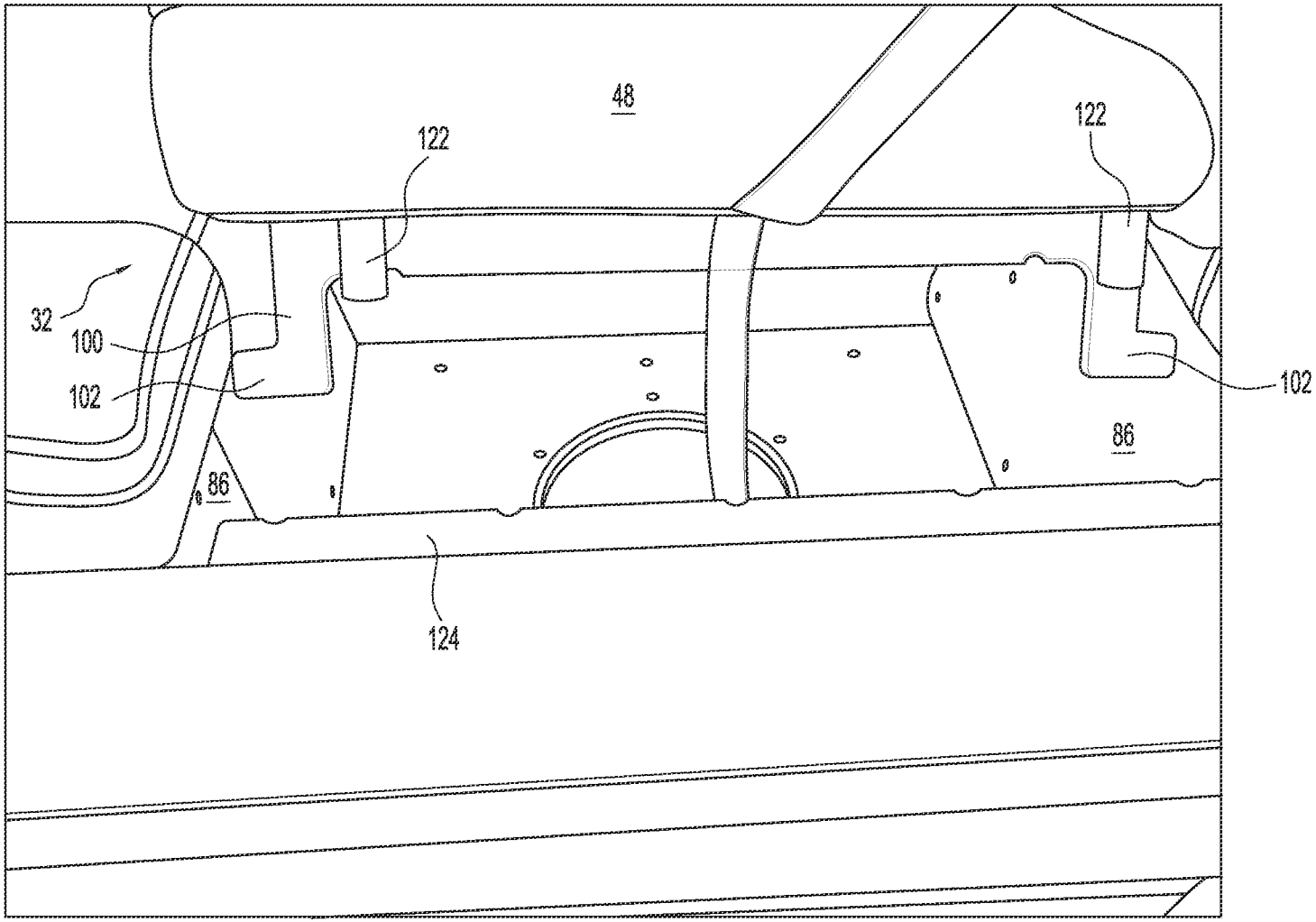
FIG. 24 is another perspective view of the front facing folding stowable seat being moved close to the upright unfolded use position.

Now referring to FIGS. 18-21, perspective views of the front facing folding and stowable seat 32 are shown. Front facing seat 32 is in a folded and stowed position for use as a step in FIGS. 18 and 20 and is opened to an upright use position as a seat in FIG. 19, including sun pad 50. FIG. 21 shows seat bottom 48 still stored in a compartment 84 and not yet raised into the use position as a seat. As discussed above, front facing seat 32 includes lid 44, which serves as a stepping surface for boaters when the seat is in the folded and stowed position. Lid 44 includes a non-slip surface 92 on the stepping surface thereof to prevent boaters from slipping when stepping thereon, as would be a problem especially when lid 44 is wet. Lid 44 is attached to boat 10 using hinges 90 (FIG. 20). One distinction to note about front facing seat 32 as compared to rear facing seats 30, is that the back cushion 46 and seat bottom 48 are not connected together with a pivoting mechanism, but rather back cushion 46 is attached to the underside of lid 44 and is raised to an upright in use position when lid 44 is raises as shown in FIGS. 19 and 21. Magnets 94 are mounted to a surface 95 on boat 10, and buttons 96 of a ferromagnetic material are mounted to lid 44 in order to hold lid 44 to surface 95 by magnetic attraction when raised to the upright position adjacent thereto. Of course, magnets 94 and buttons 96 could be switched if desired.

Referring now to FIGS. 22-28, details of foldable and moveable seat 32 and the movement mechanism thereof are shown in greater detail. A compartment 84 is provided in which seat bottom 48 is stored when the seat is in the folded and stowed position, and lid 44 is being used as a step. Compartment 84 includes a pair of sidewalls 86, a bottom wall 87, a rear wall 88, and a front wall 89.

A support member 100 is mounted to the bottom of seat bottom 48 for supporting the seat when it is in a stowed position. Support member 100 includes extensions 102 which engage bottom wall 87 when the seat is in the stowed position.

Sidewalls 86 include slots 110, which have a substantially inverted j-shape configuration. However, as compared to slots 64 of rear facing seats 30, slots 110 are set at an angle forward as best shown in FIGS. 25-28. Components to provide movement for front facing seat 32 also include a slide 112 of which ends 114 thereof are received in slots 110. Slide 110 is mounted to seat bottom 48 using brackets 116 and fasteners 117. When front facing seat 32 is in a stowed position, ends 114 of slide 112 are located at a lower end 118 of the straight section of j-shaped slot 110. At the other end of slot 110, wherein the arch of the j-shape terminates, a niche 120 is located wherein ends 114 of slide of 112 reside when front facing seat 32 is in the upright position. The arch and niche help retain slide 112 in the upright use position to prevent the seat from folding unintentionally. Additionally, seat 32 includes pins 122 extending from the bottom of seat bottom 48. When front facing seat 32 is in the use position, as shown best in FIG. 28, retaining pins 22 abut a front ledge 124 of compartment 84 to prevent the seat from moving forward, and ends 114 of slide 112 moving from niche area 120, thereby preventing the seat from collapsing while a user is sitting thereon.

Figure 25:
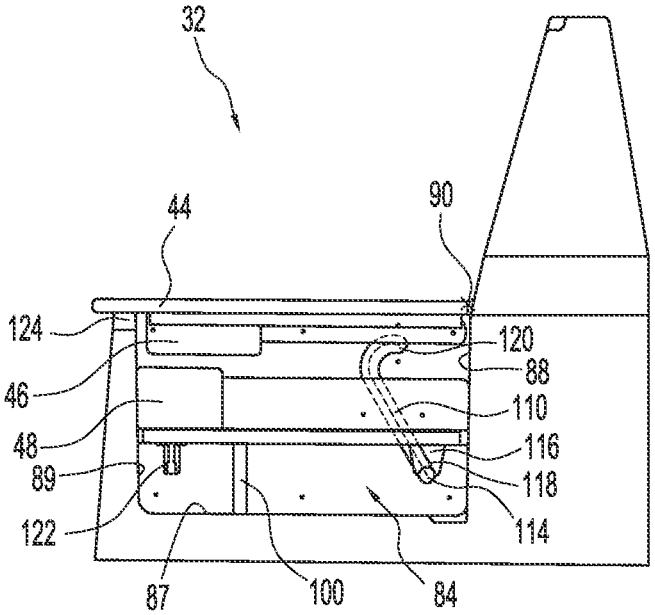
FIG. 25 is a side view of the front facing foldable stowable seat with the seat in a folded and stowed position for use as a step.
Figure 26:
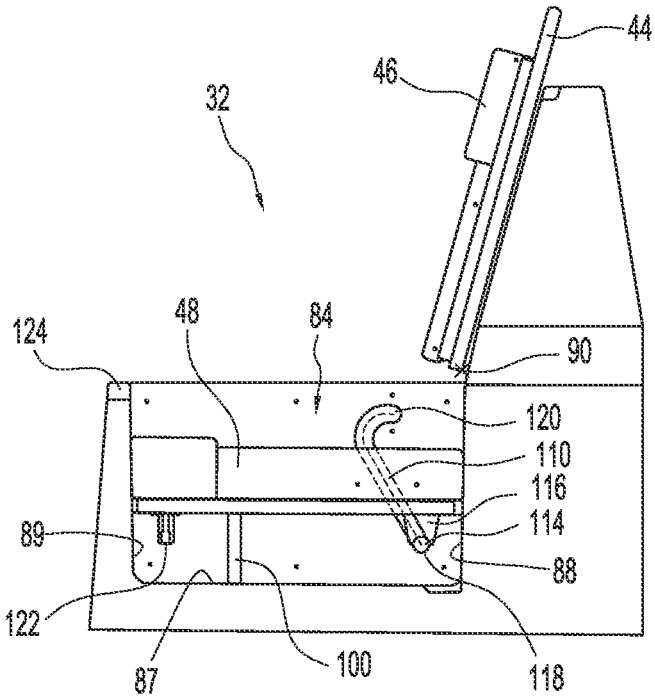
FIG. 26 is a side view of the front facing foldable stowable seat with the seat in a folded position, but the step lid and backrest in an unfolded upright position.
Figure 27:
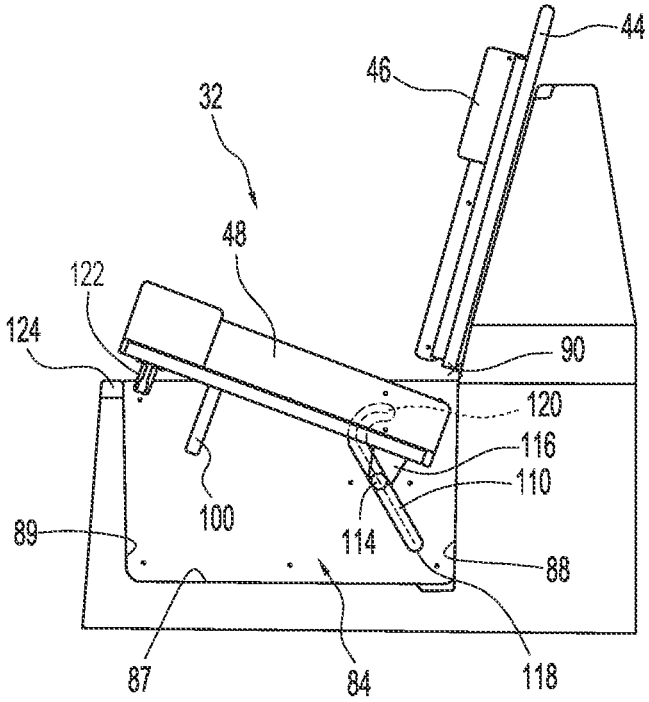
FIG. 27 is a side view of the front facing folding stowable seat with the seat partially raised to the upright and use position as a seat.
Figure 28:
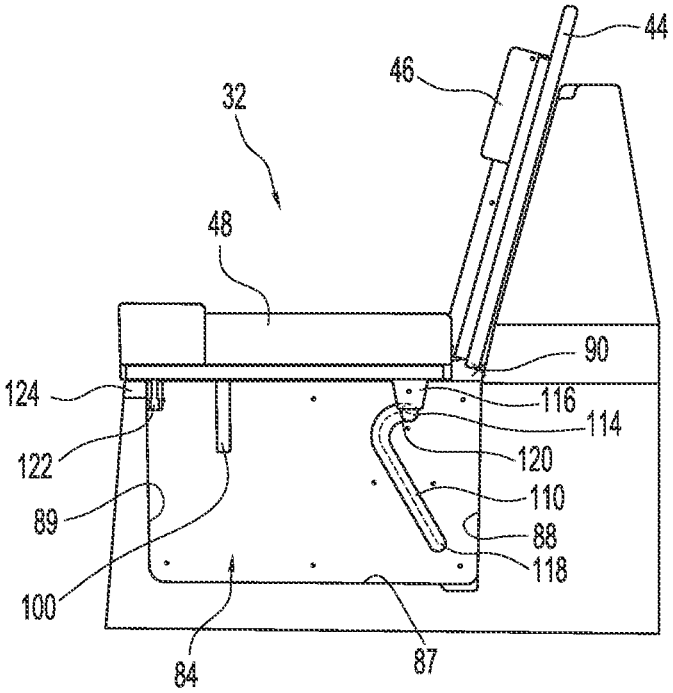
FIG. 28 is a side view of the front facing folding stowable seat with the seat in an upright unfolded position for use as a seat.

Referring particularly to FIGS. 25-26, in FIG. 25, front facing seat 32 is shown in the folded and stored position, wherein both back cushion 46 and seat bottom 48 are stored in compartment 84 and lid 44 can be used as a step by boaters. In this position, ends 114 of slide 112 are located at the bottom end of 118 of slot 110. Additionally, extensions 102 of support 100 rest on and are supported by bottom wall 87 of compartment 84. The front of lids 44 is supported by front ledge 124 of compartment 84. To move the seat into an upright position, lid 44 is rotated about hinges 90 and buttons 96 hold lid 44 in the upright position by magnetic attraction to magnets 94 located on surface 95. In FIG. 27, seat bottom 48 is in a partially raised position wherein ends 114 of slide 112 are in approximately the middle of slot 110 and the front of seat bottom 48 is raised up and out of compartment 84. Finally, as shown in FIG. 28, seat bottom 48 is pulled up to a horizontal position wherein ends 114 of slide 112 are located in niche 120 of slot 110, and retaining pins 122 abut front ledge 124. Front facing seat 32 is now ready to be occupied by a boater and used as a seat.

While the invention has been taught with specific reference to these embodiments, one skilled in the art will recognize that changes can be made in form and detail without departing from the spirit and scope of the invention. The described embodiments are to be considered, therefore, in all respects only as illustrative and not restrictive. For example, the embodiment shown as the rear facing seat may be used as a front facing seat and the embodiment shown as the front facing seat may be used for a rear facing seat. Also, for example, the shapes of the slots and retainer bars may be varied from that show. As such, the scope of the invention is indicated by the following claims rather than by the description.

The invention claimed is:

1. A stowable seat for a boat, comprising:

a plurality of upstanding walls defining a compartment having an open upper end;

a moveable lid moveably connected to the boat and moveable relative to the plurality of upstanding walls, the moveable lid moveable through a lid range of motion between: a step position covering the open upper end of the compartment and presenting a stepping surface to support a user walking atop the moveable lid over an area of the boat; and a seat back position allowing access to the compartment via the open upper end; and a seat bottom moveably secured relative to the at least one of the plurality of upstanding walls and moveable through a seat bottom range of motion between: a stowed position within the compartment, below the open upper end, and covered by the moveable lid in the step position of the moveable lid; and a use position with the seat bottom extending above the compartment and substantially enclosing the open upper end of the compartment, for use as a seat over the area of the boat, the moveable lid maintaining the seat back position to allow the seat bottom to be positioned in the use position, in the seat back position the moveable lid oriented to provide back support to a user seated on the seat bottom.

2. The stowable seat of claim 1, further comprising:

a seat back.

3. The stowable seat of claim 2, wherein the seat back comprises a seat back face of the moveable lid opposite the stepping surface.

4. The stowable seat of claim 2, where the seat back is pivotally connected to the seat bottom and pivotable into a use position atop the moveable lid in the seat back position of the moveable lid.

5. The stowable seat of claim 1, wherein the stepping surface of the moveable lid comprises a non-slip surface.

6. The stowable seat of claim 1, further comprising a magnetic retainer positioned to selectively magnetically retain the moveable lid in the seat back position.

7. The stowable seat of claim 1, wherein said plurality of upstanding walls comprises a pair of sidewalls, a front wall, and a back wall.

8. The stowable seat of claim 7, wherein each of the pair of sidewalls includes a slot therein, said stowable seat further comprising a slide attached to the seat bottom.

9. The stowable seat of claim 8, wherein the slots in each of the sidewalls has a substantially j-shaped configuration, and each of two opposing ends of the slide are located in and configured to be moveable within one of the slots through the seat bottom range of motion.

10. The stowable seat of claim 9, wherein the ends of the slide are located in a lower end of the j-shaped configuration slots when the seat bottom is in a stowed position and the ends of the slide are each located in a niche at an end of an arch of each of the j-shaped configuration slots when the seat bottom is in the use position.

11. The stowable seat of claim 10, wherein a front edge of the seat bottom is supported on a ledge at a front edge of the open upper end when the seat bottom is in the use position.

12. The stowable seat of claim 1, wherein the moveable lid comprises a seat back, the seat back positioned in the compartment when the moveable lid is positioned for use as a step.

13. The stowable seat of claim 1 in combination with:

a boat.

14. The stowable seat of claim 13, wherein the stowable seat of claim 1 comprises a front facing stowable seat and the combination further comprises a second stowable seat as set forth in claim 1, the second stowable seat comprising a rear facing stowable seat.

15. A stowable seat, comprising:

at least one wall defining a compartment having an open upper end;

a seat back;

a seat bottom;

a movement assembly connecting said seat bottom to said compartment, the movement assembly facilitating movement of the seat bottom from a stowed position contained entirely within the compartment to a use position wherein said seat bottom is at least partially outside of the compartment and substantially enclosing the open upper end of the compartment; and a moveable lid attached with a hinged connection to the boat, the lid covering the compartment when the seat bottom is stowed, and a top side of the lid is configured for use as a step, and the lid is raisable about the hinged connection to an upright position to allow the seat bottom to be moved into a use position.

16. The stowable seat as set forth in claim 15, wherein the at least one wall defining a compartment comprises a pair of sidewalls, and wherein the movement assembly includes a slot in each of the sidewalls defining the compartment, and a slide attached to the seat bottom.

17. The stowable seat as set forth in claim 16, wherein the slot in each of the sidewalls has a substantially j-shaped configuration, and each of two opposing ends of the slide are located in and configured to be moveable within one of the slots.

18. The stowable seat as set forth in claim 17, wherein the j-shaped configuration slots are inverted in said sidewalls of said compartment.

19. The stowable seat as set forth in claim 18, wherein said inverted j-shaped configuration slots are angled forward.

20. The stowable seat as set forth in claim 19, wherein the ends of the slide are located in a lower end of the j-shaped configuration slots when the seat bottom is in a stowed position.

21. The stowable seat as set forth in claim 20, wherein the ends of the slide are each located in a niche at an end of an arch of each of the j-shaped configuration slots when the seat bottom is in the use position.

22. The stowable seat as set forth in claim 21, wherein the seat back maintains a substantially vertical orientation in the compartment when the seat back is in the stowed position.

23. The stowable seat as set forth in claim 22, wherein the seat bottom also maintains a substantially vertical orientation in the compartment when the seat bottom is in the stowed position.

24. The stowable seat as set forth in claim 23, including a pivoting connection connecting said seat bottom and said seat back.

25. The stowable seat as set forth in claim 24, further including a cavity beneath said lid when the lid is in a raised upright position, and a retainer connected to said seat bottom, said retainer received in said cavity when the seat bottom is in the use position.

26. The stowable seat as set forth in claim 25, wherein said retainer abuts a bottom wall of the compartment when the seat is in the stowed position.

27. The stowable seat as set forth in claim 26, wherein a front edge of the seat bottom is supported opposite the retainer on a ledge at a front edge of the open upper end when the seat bottom is in the use position.

28. The stowable seat as set forth in claim 22, wherein said seat back maintains a substantially horizontal orientation when the seat bottom is in the stowed position.

29. The stowable seat as set forth in claim 28, wherein the seat back is attached to the lid, the seat back positioned in the compartment when the moveable lid is positioned for use as a step.

30. The stowable seat as set forth in claim 29, further including a support attached to said seat bottom, and the support abuts a bottom wall of the compartment when the seat bottom is in the stowed position.

31. The stowable seat as set forth in claim 30, including at least one retainer that abuts a front ledge of the compartment when the seat bottom is in a use position to prevent the seat bottom from moving from the use position when a boater is sitting thereon.

32. The stowable seat as set forth in claim 27, further including a strap attached to the seat back, the strap positioned to allow a boater to raise the seat bottom from the stowed position to the use position while grasping the strap.

33. The stowable seat of claim 15 in combination with: a boat.

34. The combination as set forth in claim 33, wherein the stowable seat as set forth in claim 1 comprises a front facing stowable seat and the combination further comprises a second stowable seat as set forth in claim 1, the second stowable seat comprising a rear facing stowable seat.

* * * * *